United States Patent [19]

Yoshioka et al.

[11] Patent Number: 4,568,170

[45] Date of Patent: Feb. 4, 1986

[54] SUPPORTING FRAME FOR A VARIABLE RATIO ELECTROSTATIC COPYING APPARATUS

[75] Inventors: Masahiro Yoshioka, Matsubara; Masahiro Murakami, Shijonawate; Yoichiro Irie, Suita; Tsugio Nakanishi, Osaka; Eiji Tsutsui, Amagasaki; Noriyuki Iwao, Kobe; Junichi Hirobe, Osaka; Takahiro Wakikaido, Yao, all of Japan

[73] Assignee: Mita Industrial Co., Ltd., Japan

[21] Appl. No.: 732,328

[22] Filed: May 9, 1985

Related U.S. Application Data

[62] Division of Ser. No. 424,943, Sep. 27, 1982.

[30] Foreign Application Priority Data

Nov. 30, 1981 [JP] Japan ..... 56-192395

[51] Int. Cl.[4] ..... G03G 15/00

[52] U.S. Cl. ..... 355/8; 355/56; 355/3 R; 355/11

[58] Field of Search ..... 355/8, 3 R, 14 R, 55, 355/56, 52, 67, 35, 57, 11

[56] References Cited

U.S. PATENT DOCUMENTS

| | | | |
|---|---|---|---|
| 3,865,482 | 2/1975 | Bendall et al. | 355/14 R |
| 3,901,586 | 8/1975 | Suzuki et al. | 355/57 X |
| 3,901,593 | 8/1975 | Kogiso et al. | 355/11 |
| 4,441,805 | 4/1984 | Smith | 355/55 X |
| 4,472,048 | 9/1974 | Satomi | 355/8 |
| 4,519,702 | 5/1985 | Shigemura et al. | 355/8 X |
| 4,521,100 | 6/1985 | Yonemori et al. | 355/8 |

*Primary Examiner*—A. C. Prescott

*Attorney, Agent, or Firm*—Beveridge, De Grandi & Weilacher

[57] ABSTRACT

An electrostatic copying process and apparatus capable of forming copies in at least two different ratios. The formation of a copied image involves exposure scanning of the image of an original document and projecting it on a photosensitive member through an optical device. The change of the ratio of copying is achieved by changing the ratio of projection of the image of the document onto the photosensitive member by the optical device, and also changing the speed of scanning.

4 Claims, 22 Drawing Figures

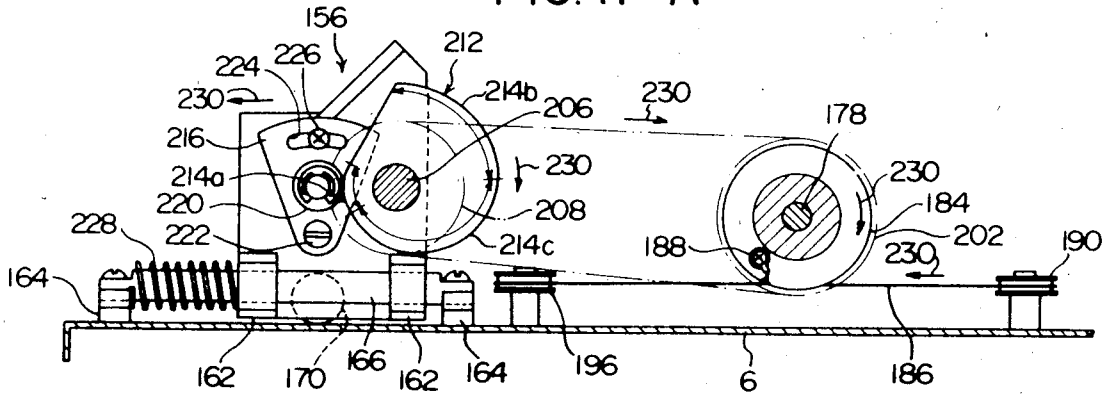
FIG. 11-A
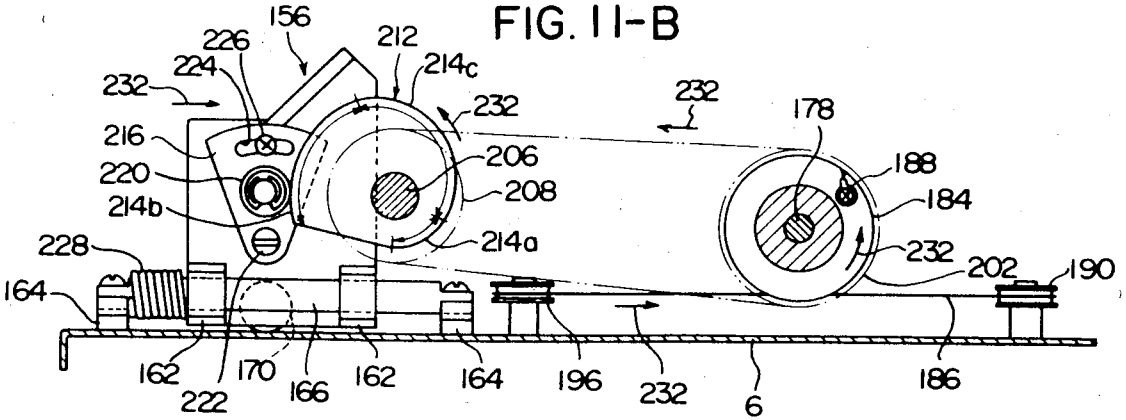
FIG. 11-B

FIG. 12-A
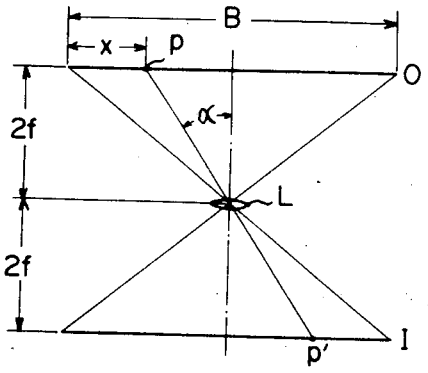
FIG. 12-B
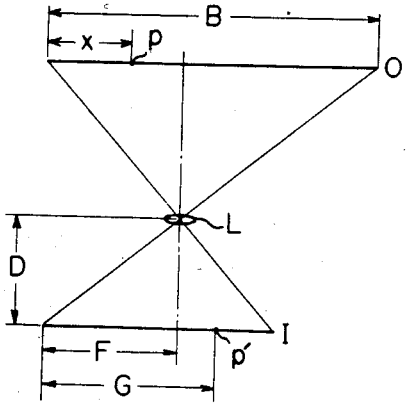
FIG. 13
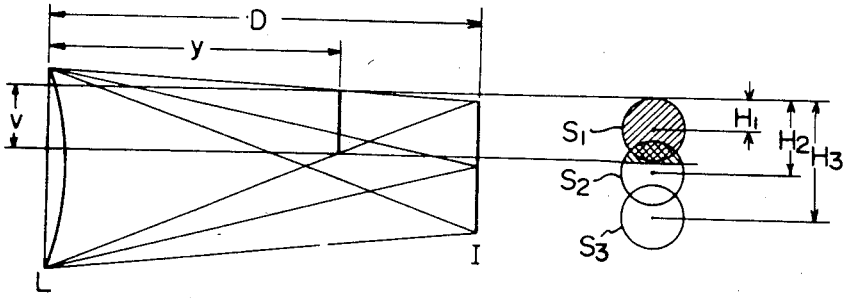

SUPPORTING FRAME FOR A VARIABLE RATIO ELECTROSTATIC COPYING APPARATUS

This is a division, of application Ser. No. 424,943, filed Sept. 27, 1982.

FIELD OF THE INVENTION

This invention relates to an electrostatic copying process and apparatus, and particularly to an electrostatic copying process and apparatus capable of giving copies at variable ratios including enlargement and reduction.

DESCRIPTION OF THE PRIOR ART

Various types of electrostatic copying processes and apparatuses have recently been proposed, and come into commercial acceptance, which can copy an original document selectively at two or more ratios, for example at a ratio of 1 and on a reduced or enlarged scale at a predetermined ratio. These conventional processes and apparatuses adapted for selection of variable ratios, however, have not proved to be entirely satisfactory, and are not free from various inconveniences and defects as will be understood from the detailed description of the invention which follows with reference to the accompanying drawings.

SUMMARY OF THE INVENTION

The present invention has been accomplished in view of the above fact, and its primary object is to overcome or eliminate the various inconveniences and defects of conventional electrostatic copying processes and apparatuses capable of giving copies at variable ratios, and to improve them in various respects.

BRIEF DESCRIPTION OF THE DRAWINGS

FIGS. 11-A and 11-B are partial sectional views showing the other supporting frame of the optical device used in the copying apparatus shown in FIG. 1 and its related elements at the equal scale position and the reduced scale position, respectively;

FIGS. 12-A, 12-B and 13 are diagrammatic views for illustrating variations in illuminance and their adjustment in the case of reduced (or enlarged) scale copying;

DETAILED DESCRIPTION OF THE PREFERRED EMBODIMENTS

With reference to the accompanying drawings, the present invention will be described in greater detail.

Outline of the General Construction of the Copying Apparatus

Figure 1:
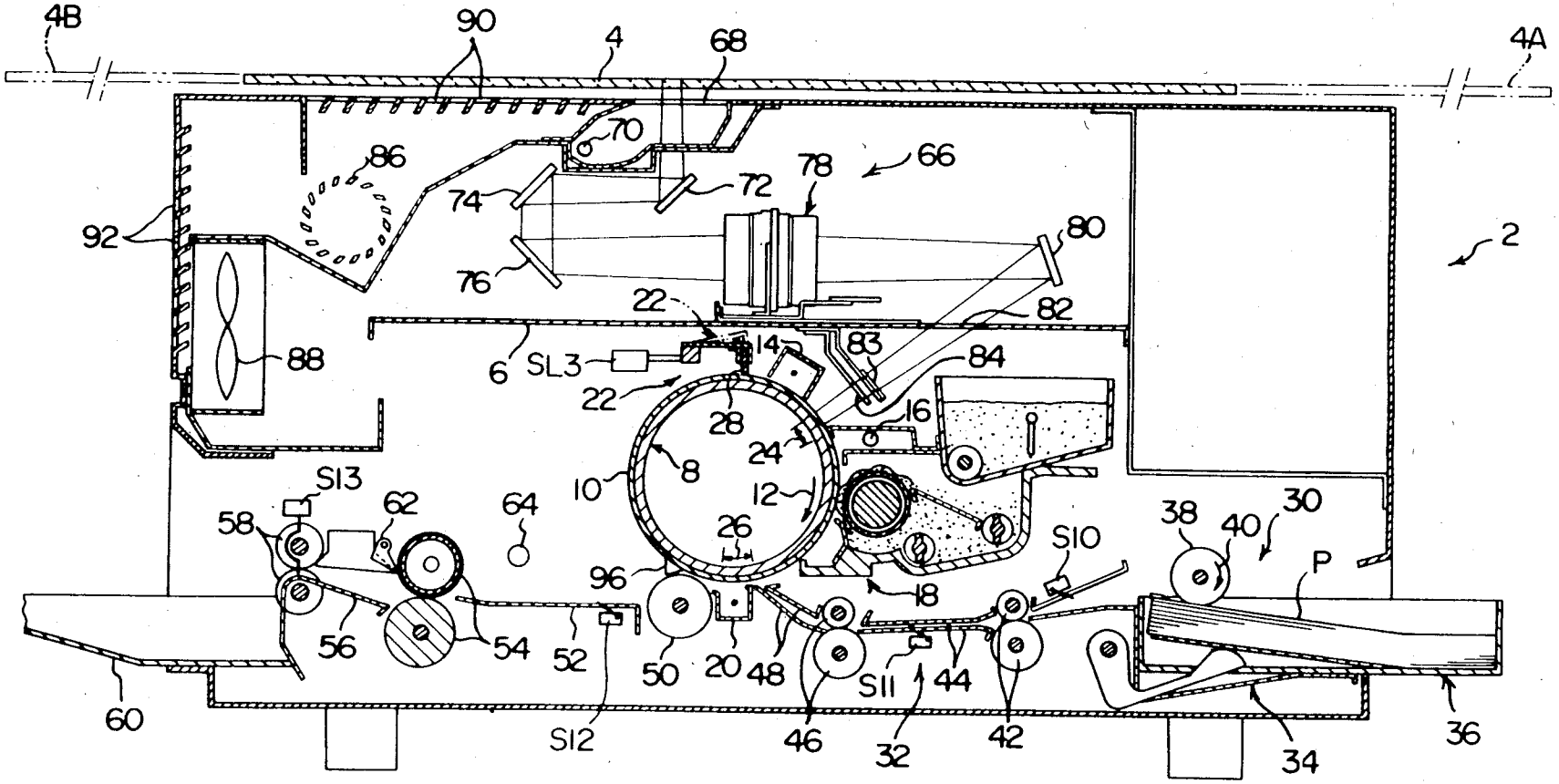
FIG. 1 is a simplified sectional view showing one embodiment of a copying apparatus constructed in accordance with this invention.

The general construction of the copying apparatus of the invention capable of giving copies at variable ratios will be described at some length with reference to FIG. 1 showing its one embodiment.

The illustrated copying apparatus has a substantially parallelpipedal housing shown generally at 2. On the upper surface of the housing 2 is disposed a transparent plate 4 on which to place an original document to be copied. The transparent plate 4 is supported by a supporting frame (not shown) mounted on the upper surface of the housing 2 for free movement in the left and right directions in FIG. 1. As will be described in detail, in the performance of a copying process, the transparent plate 4 is caused to make a preparatory movement toward the right in FIG. 1 from its stop position shown by solid lines in FIG. 1 to its start-of-scan position shown by a two-dot chain line 4A in FIG. 1; then to make a scanning movement toward the left in FIG. 1 from the start-of-scan position to its end-of-scan position shown by a two-dot chain line 4B; and thereafter to make a returning movement from the end-of-scan position to its stop position. An openable and closable document holding member (not shown) for convering the transparent plate 4 and the document thereon is also mounted on the supporting frame (not shown) on which the transparent plate 4 is supported.

Within the housing 2, a horizontal base plate 6 is disposed to divide the inside of the housing 2 into an upper space and a lower space. Substantially centrally in the lower space is rotatably mounted a cylindrical rotating drum 8 constituting a supporting base for a photosensitive member, and a photosensitive member 10 is disposed on at least a part of the peripheral surface of the rotating drum 8. Instead of the rotating drum 8, there may be used an endless belt-like element known to those skilled in the art, and the photosensitive member 10 may be disposed on at least a part of the surface of the endless belt-like element.

Around the rotating drum rotated in the direction of an arrow 12 are disposed successively in its rotating direction a charging corona discharging device 14, a charge-eliminating lamp 16 to be operated during reduced scale copying, a developing device 18, a transfer corona discharging device 20 and a cleaning device 22. The charging corona discharging device 14 charges the photosensitive member 10 to a specified polarity substantially uniformly. An exposure zone 24 exists between the charging corona discharging device 14 and the charge-eliminating lamp 16. In the exposure zone 24, the image of the original document on the transparent plate 4 is projected by an optical device to be described hereinbelow, thereby forming a latent electrostatic image on the photosensitive member 10. As will be described hereinbelow, the charge-eliminating lamp 16 is operated when reduced scale copying is performed. The lamp 16 illuminates one side portion of the photosensitive member 10 which has been charged by the corona discharger 14 but on which the image of the original document has not been projected in the exposure zone 24. Thus, the electric charge on this one side portion is removed. The developing device 18 which may be of any known form applies toner particles to the latent electrostatic image on the photosensitive member 10 to develop it into a toner image. The transfer corona discharging device 20 applies a corona discharge to the back of a copying paper to be contacted with the surface of the photosensitive member 10 in a transfer zone 26, thereby transferring the toner image on the photosensitive member 10 to the copying paper. The illustrated cleaning device 22 is se1ectively held at its operating position shown by a solid line in FIG. 1 or its non-operating position shown by a two-dot chain line. When the cleaning device 22 is held at the operating position, a blade 28 made of an elastic material is pressed against the surface of the photosensitive member 10, and by the action of the blade 28, the residual toner particles on the photosensitive member 10 after transfer are removed from it.

In the lower portion of the housing 2, there are provided a copying paper feed mechanism shown generally at 30 and a copying paper conveying mechanism shown generally at 32 for conveying a copying paper from the paper feed mechanism 30 through the transfer zone 26. The illustrated paper feed mechanism 30 is known per se and comprises a cassette-receiving section 34, a paper cassette 36 to be mounted detachably on the cassette-receiving section 34 and a feed roller 38. The feed roller 38 is rotated selectively in the direction shown by an arrow 40, and feeds a plurality of sheet-like copying papers placed in the stacked state in the cassette 36 one by one to the paper conveying mechanism 32. The illustrated paper conveying mechanism 32 comprises a delivery roller unit 42 for receiving, and conveying, copying paper P fed from the paper feed mechanism 30, a guide plate unit 44, a conveying roller unit 46, a guide plate unit 48 for guiding the copying paper P from the conveying roller unit 46 into the transfer zone 26, a roller 50 for peeling off the copying paper P from the photosensitive member 10 in the transfer zone 26 and carrying it away from the transfer zone 26, a guide plate 52, a fixing roller unit 54, a guide plate 56, a discharge roller unit 58 and a receiving tray 60 for receiving the copying paper P discharged out of the housing 2 from the discahrging roller unit 58. One set of rollers in the fixing roller unit 54, i.e. those rollers which are located at its upper part, include a heating element (not shown) therein. Thus, by these rollers the surface of the copying paper P having a toner image transferred from the photosensitive member 10 is pressed and heated to fix the toner image on the copying paper P. To the fixing roller unit 54 is attached a peeling-guide member 62 for peeling the copying paper P from the roller surface and guiding it downstream. A charge-eliminating lamp 64 is disposed above the guide plate 52. The charge-eliminating lamp 64 serves to irradiate light onto the paper P conveyed to the guide plate 52 and thereby erasing the charge remaining on the paper P, and also to irradiate light onto the photosensitive member 10 in a zone between the corona discharging device 20 and the cleaning device 22 thereby erasing the charge remaining on the photosensitive member 10 after transfer.

In the upper space of the housing 2 above the horizontal base plate 6, there is provided an optical device shown generally at 66 which projects the image of an original document placed on the transparent plate 4 onto the photosensitive member 10 to effect slit exposure when the transparent plate 4 makes a scanning movement toward the left in FIG. 1 from its start-of-scan position shown by the two-dot chain line 4A to its end-of-scan position shown by the two-dot chain line 4B. The illustrated optical device 66 has a document illuminating lamp 70 for illuminating the document on the transparent plate 4 through a document illuminating opening 68 formed on the upper surface of the housing 2, and for projecting the light reflected from the document onto the photosensitive member 10, a first reflecting mirror 72, a second reflecting mirror 74, a third reflecting mirror 76, a lens assembly 78 and a fourth reflecting mirror 80. The reflecting light from the document illuminated by the lamp 70 is successively reflected by the first reflecting mirror 72, the second reflecting mirror 74, and the third reflecting mirror 76, and then reaches the fourth reflecting mirror 80 through the lens within the lens assembly 78. It is reflected by the fourth reflecting mirror 80, and finally reaches the photosensitive member 10 in the exposure zone 24 through an opening 82 formed in the horizontal base plate 6. Between the opening 82 and the photosensitive member 10 is provided a colored glass 83 known per se which compensates the color characteristics of the photosensitive member 10. A slit exposure width-regulating member 84 for regulating the width, in the moving direction of the photosensitive member 10 (the moving direction of the transparent plate 4), of a light path leading to the photosensitive member, i.e. the slit exposure width, is also disposed between the opening 82 and the photosensitive member 10.

In the illustrated copying apparatus, there are further provided a blower 86 composed of a Silocco-type fan and a blower 88 composed of an ordinary impeller-type fan at the left side end portion of the housing 2 in FIG. 1. The blower 86 sucks air from outside the housing 2 through a suction hole 90 formed on the upper surface of the housing 2, and discharges air through a discharge hole 92 formed on the left side surface of the housing 2, thereby cooling the transparent plate 4 heated by the illuminating lamp 70. The blower 88, on the other hand, sucks air from the lower space of the housing 2 below the horizontal base plate 6 and discharges it through the discharge hole 92 formed on the left side surface of the housing 2, thereby preventing the heat of the fixing roller unit 54 from being transmitted to the photosensitive member 10 and thereby from deteriorating the photosensitive member 10.

The illustrated copying apparatus is constructed such that the copying process can be performed selectively in at least two copying ratios, for example either equal scale copying or reduced scale copying at a ratio of about 0.7 in length and about 0.5 in area is selectively carried out. This feature will be described in detail later on, and for the time being, the basic principle of variable ratio copying in the illustrated copying apparatus is briefly described below.

In the illustrated copying apparatus, the rotating drum 8 is rotated always at a predetermined speed irrespective of the ratio of copying. The paper conveying mechanism 32 also conveys the copying paper P through the transfer zone 26 always at a predetermined speed irrespective of the ratio of copying, namely at substantially the same speed as the moving speed of the photosensitive member 10 disposed on the peripheral surface of the rotating drum 8. In contrast, the transparent plate 4 is caused to make a scanning movement at a speed varying according to the ratio of copying, and the optical device 66 projects the image of an original document placed on the transparent plate 4 onto the photosensitive member 10 at a prescribed ratio of copying. Specifically, when the copying process is performed at a ratio of substantially 1, the transparent plate 4 is caused to make a scanning movement substantially at the same speed as the moving speed of the photosensitive member 10 (and the moving speed of the copying paper through the transfer zone 26), and the optical device 66 projects the image of the original document at a ratio of substantially 1. However, when the copying process is carried out at a predetermined ratio of copying, for example at a length ratio of M (e.g., M=about 0.7), the transparent plate 4 is caused to make a scanning movement at a speed corresponding to VM where V is the speed employed in the case of performing equal scale copying, and consequently, the size, in the moving direction of the photosensitive member 10 (scanning direction), of a latent electrostatic image formed on the photosensitive member 10 is reduced (or enlarged) to M times. At the same time, the optical device 66 projects the image of the original document placed on the transparent plate 4 onto the photosensitive member 10 at a ratio of M as a result of the lens assembly 78, second reflecting mirror 74 and third reflecting mirror 76 being moved respectively to prescribed positions as will be described in detail hereinbelow. As a result, the widthwise size of the latent electrostatic image formed on the photosensitive member 10 is reduced (or enlarged) to M times. In this way, a latent electrostatic image reduced (or enlarged) to M times in length is formed on the photosensitive member 10, and the reduced (or enlarged) latent electrostatic image is developed to a toner image and transferred to a copying paper. Thus, a reduced (or enlarged) copied image is obtained.

Widthwise Positioning of a Projected Image on the Photosensitive Member

It is well known to those skilled in the art that in a so-called transfer-type electrostatic copying apparatus adapted to form a latent electrostatic image or a toner image on the photosensitive member 10 disposed on the peripheral surface of the rotating drum 8, and contact a copying paper P with the surface of the photosensitive member 10 in the transfer zone 26 thereby transferring the latent electrostatic image or the toner image on the photosensitive member 10 to the copying paper P, the copying paper P adheres fairly strongly to the surface of the photosensitive member 10 in the transfer zone 26 by the action of electrostatic charge, and it is not always easy to peel off the copying paper P from the photosensitive member 10 after transfer. In order to cope with this situation, a paper separating channel 94 is formed at one side portion of the rotating drum 8, and the photosensitive member 10 is disposed inwardly of the channel 94 as in clearly shown in FIG. 2. The copying paper P is contacted with the photosensitive member 10 in such a manner that its one side edge portion extends outwardly beyond one side edge 10*a* of the photosensitive member 10 by a predetermined width $w_1$ and is positioned in an area where the channel 94 is formed, i.e. a nonimage area for paper separation. In peeling off the paper P from the photosensitive member 10, the action of a peeling nail-like member 96 (FIG. 1) projecting from the channel permits accurate separation of the copying paper P from the photosensitive member 10.

Figure 2:
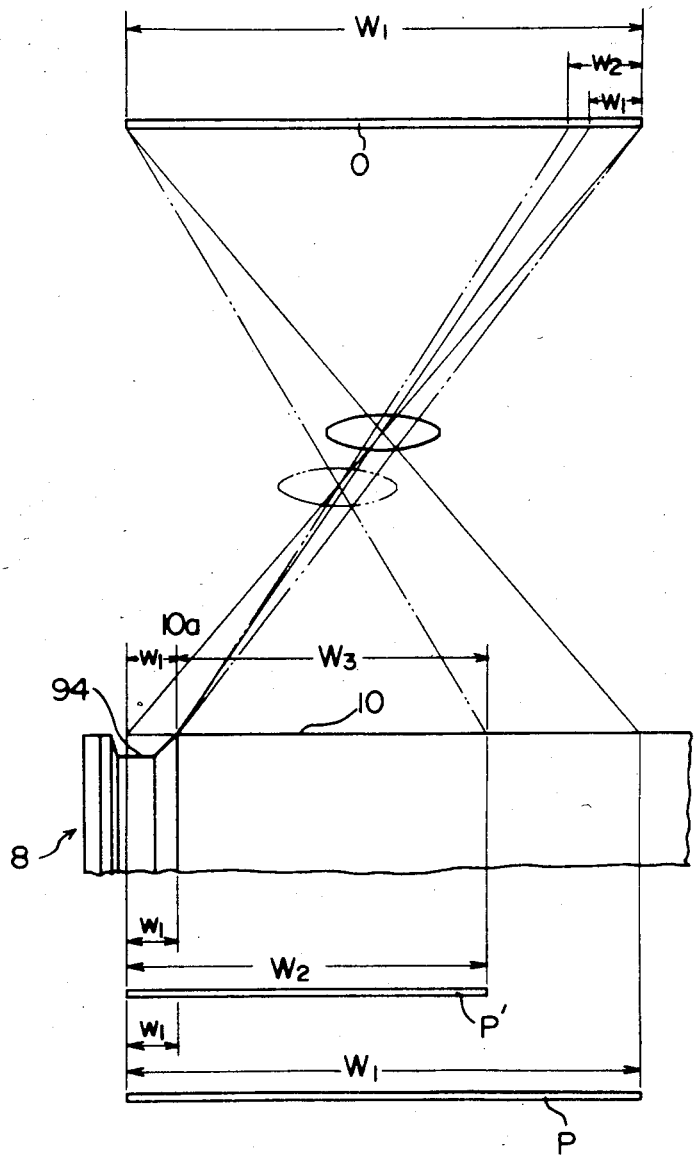
FIGS. 2, 3 and 4 are diagrammatic views for illustrating the widthwise positioning of a projected image on a photosensitive member in the case of reduced (or enlarged) scale copying.

When substantially equal scale copying is carried out in a copying apparatus of the aforesaid construction, the image of the original document O is projected onto the rotating drum 8 in register with the widthwise position of the copying paper P with respect to the rotating drum as shown by solid lines in FIG. 2. In other words, the image of the original document O is projected substantially at a ratio of 1 onto the rotating drum such that one side edge portion of the image of the document O extends beyond the side edge 10*a* of the photosensitive member 10 by the predetermined width $w_1$ and is thus located at a nonimage area for paper separation where the channel 94 is formed. As will be readily seen from FIG. 2, therefore, the portion having the width $w_1$ of one side edge portion of the original document O is located correspondingly to the predetermined width $w_1$ of one side edge portion of the copying paper P and forms a nonimage area in which a copied image is not formed on the copying paper P. However, since the predetermined width $w_1$ of one side edge of the original document is usually a white background having no image to be copied, no particular inconvenience is caused if that portion becomes a non-copying portion.

When the copying process is perfomed at a copying ratio of M ($M=W_2/W_1$) using an original document having a total width of $W_1$ and a copying paper P' having a total width of $W_2$ in the conventional variable ratio electrostatic copying, the same method as in the case of performing the copying process at a copying ratio of substantially 1 is employed. Specifically, the image of the original document to be projected onto the rotating drum 8 on a reduced (or enlarged) scale at a length ratio of M is registered with the widthwise position of the copying paper P' with respect to the rotating drum 8. In other words, the image of the original document O is positioned widthwise such that a portion having the predetermined width $w_1$ of one side edge portion of the projected image on the rotating drum 8 extends beyond the side edge 10*a* of the photosensitive member 10 and is positioned in a nonimage area for paper separation in which the channel 94 is formed. When the copying process is carried out at a copying ratio in length of M in such a conventional variable ratio electrostatic copying, the width of one side edge portion of the copying paper P' in which no copied image is formed is $w_1$ as in the case of equal scale copying. But the non-copying width of one side edge portion of the original document O projected onto the paper separating nonimage area of the rotating drum 8 is increased (or reduced) to $w_2$($w_2=w_1/M$), and the portion having the width $w_2$ will not be converted to a copied image. This is unnatural in that while the non-copying width of one side edge portion of the original document O is $w_1$ in the case of substantially equal scale copying, it is $w_2$ ($w_2=w_1/M$) when the copying process is performed at a length ratio of M. Particularly in the case of reduced scale copying (i.e., $M<1$), the non-copying width at one side edge portion of the original document O which is not converted to a copied image is increased from $w_1$ to $w_2$ ($w_2=w_1/M$). This causes the inconvenience that not only the white background area at one side edge portion of the original document O, but also that part of the original document O at which an image to be copied is present will not be converted to a copied image.

In an attempt to solve or eliminate the aforesaid problem or defect of the conventional variable ratio electrostatic copying, the specification of Japanese Laid-Open Patent Publication No. 28068/1980 discloses that in the case of reduced (or enlarged) scale copying, the ratio M' of the total width $W_3$ of an image projected on the rotating drum 8 to the total width $W_1$ of the original document O ($M'=W_2/W_1$) is made lower (or higher) than the ratio M of the total width $W_2$ of a copying paper to the total width $W_1$ of the original document O ($M=W_2/W_1$) to provide $W_3=W_2-w_1$, and the image of the original document O projected onto the rotating drum 8 at a length ratio of M' is positioned widthwise while being registered with the image-forming portion (that part of one side edge portion which is other than the portion having a width $w_1$) of the copying paper P'. By this contrivance, the entire width $W_1$ of the original document O is imaged as a copied image in the image-forming portion ($W_2-w_1$) of the copying paper P. The method disclosed in Japanese Laid-Open Patent Publication No. 28086/1980, however, has one or more disadvantages described below.

(a) When the copying process is carried out substantially at a ratio of 1, the non-copying width $w_1$ at one side edge portion of the original document O (this portion is usually a white background) is not imaged as a copied image on the copying paper P. In contrast, reduced (or enlarged) scale copying is unnatural in that a non-copying width does not exist and the entire width $W_1$ of the original document O is imaged as a copied image on the image-forming portion ($W_2-w_1$) of the copying paper P' (hence, when one side edge portion of the original document is a white background, a white background having a fairly larger width than $w_1$ occurs in one side edge portion of the copying paper P').

(b) There is an unnatural feeling because a considerable difference exists between the ratio M of the width $W_2$ of the copying paper P' to the width $W_1$ of the original document O ($M=W_2/W_1$) and the ratio M' of the width $W_3$ of the copied image on the copying paper P' to the width $W_1$ of the image of the original document O ($M'=W_3/W_1$).

According to this invention, the above disadvantages can be overcome by performing the copying process such that irrespective of the ratio of copying, only that portion having a predetermined width $w_1$ at one side edge portion of the original document O is always projected as a non-copying portion onto a paper separating nonimage area (an area where the channel 94 is formed) constituting the supporting base.

Figure 3:
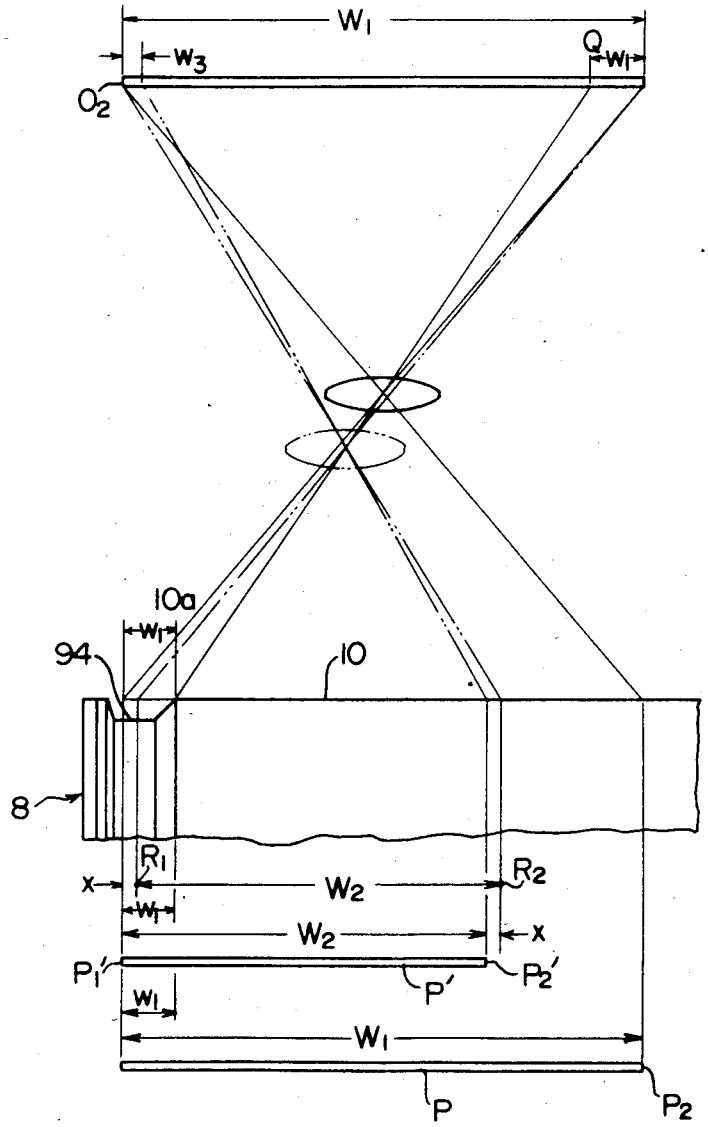

With reference to FIG. 3, this feature of the invention will be described. When the copying process is performed substantially at a ratio of 1, the image of the original document O is projected on the rotating drum 8 while it is registered with the widthwise position of the copying paper P with respect to the rotating drum as in the conventional practice, as shown by a solid line in FIG. 3. Hence, as in the conventional practice, that portion having a predetermined width $W_1$ at one side edge portion of the original document O is projected onto the paper separating nonimage area (the area in which the channel 94 is formed) on the rotating drum 8 while it is located correspondingly to the predetermined width $w_1$ of one side edge portion of the copying paper P; and thus it becomes a non-copying portion which is not imaged as a copied image on the copying paper P.

On the other hand, when the copying process is performed in a reduced (or enlarged) mode at a length ratio of M ($M=W_2/W_1$), the projected image of the original document O on the rotating drum 8 is positioned widthwise so that the inside edge Q of the non-copying portion having the predetermined width $w_1$ in one side edge portion of the original document O in the case of performing substantially equal scale copying corresponds with the inside edge of the paper separating non-image area on the rotating drum 8, i.e. the one side edge 10*a* of the photosensitive member 10, as shown by a two-dot chain line in FIG. 3. Thus, only that portion having the predetermined width $w_1$ in one side edge portion of the original is always projected onto the paper-separating nonimage area of the rotating drum 8 irrespective of the ratio of copying. It will thus be appreciated easily by reference to FIG. 3 that in performing the copying process in a reduced (or enlarged) mode, only that portion having the predetermined width $w_1$ in one side edge portion of the original document O is located within a portion of the predetermined width $w_1$ in one side edge portion of the copying paper P or P' as in the case of performing substantially equal scale copying, and the non-copying width at one side edge portion of the original document O is always maintained at the predetermined value $w_1$ irrespective of the ratio of copying. Accordingly, unnaturalness does not occur even in the case of reduced (or enlarged) scale copying.

On the other hand, if the image of the original document O projected on the rotating drum 8 at a length ratio of M ($M=W_2/W_1$) as shown by a two-dot chain line in FIG. 3, one side edge $R_1$ of the projected image on the rotating drum 8 is located inwardly (outwardly in an enlarging copying mode) of one side edge $P'_1$ of the copying paper P' always positioned in place with respect to the rotating drum 8 by a slight width x. Hence, when in a reduced (or enlarged) copying mode a copying paper P' having the same total width $W_2$ as the total width $W_2$ of the projected image on the rotating drum 8 is used or in other words the ratio M of the width $W_2$ of the copying paper used to the total width $W_1$ of the original document O ($M=W_2/W_1$) is made substantially the same as the ratio M of the total width $W_2$ of the projected image on the rotating drum 8 to the total width $W_1$ of the original document O ($M=W_2/W_1$), the other side edge $R_2$ of the projected image on the rotating drum 8 is located outwardly (inwardly in an enlarged copying mode) of the other side edge $P_2'$ of the copying paper P' by a slight width x, as illustrated in FIG. 3. For this reason, when substantially equal scale copying is carried out, the other side edge $O_2$ of the original document O is substantially registered with the other side edge $P_2$ of the copying paper P. But in a reduced copying mode, that portion having a slight width $w_3$ at the other side edge portion of the original document O extends beyond the other side edge $P_2'$ of the copying paper P' and is not imaged as a copied image (this, however, will usually not give rise to any particular problem since that portion having the width $w_3$ in the other side edge portion of the original document O is usually a white background). In an enlarging copying mode, the other side edge $Q_2$ of the original document O is located slightly inwardly of the other side edge of the copying paper.

This minor inconvenience may be removed by adjusting the total width of the image of the original document O projected on the rotating drum 8 to $W_4$ which is slightly smaller than the total width $W_2$ of the copying paper P', or in other words, by making the ratio M'' of the total width $W_4$ of the projected image on the rotating drum 8 to the total width $W_1$ of the original document O slightly lower than the ratio M of the total width $W_2$ of the copying paper P' to the total width $W_1$ of the original document O ($M=W_2/W_1$). As will be seen from FIG. 4, the other side edge $R_2$ of the projected image on the rotating drum 8 is registered with the other side edge $P_2'$ of the copying paper P' and therefore, the other side edge $O_2$ of the original document O is registercd with the other side edge $P_2'$ of the copying paper P', thereby forming a reduced copied image. In an enlarged scale copying mode, the total width of the image of the original document O projected onto the rotating drum 8 is made slightly larger than the total width of the copying paper, or in other words, the ratio M''' of the total width of the projected image on the rotating drum 8 to the total width $W_1$ of the original document is made slightly higher than the ratio of the total width of the copying paper to the total width $W_1$ of the original document O. As a result, the other side edge of the projected image on the rotating drum 8 can be registered with the other side edge of the copying paper, and therefore, the other side edge $O_2$ of the original document O can be registered with the other side edge of the copying paper, thereby forming an enlarged copied image.

Figure 4:
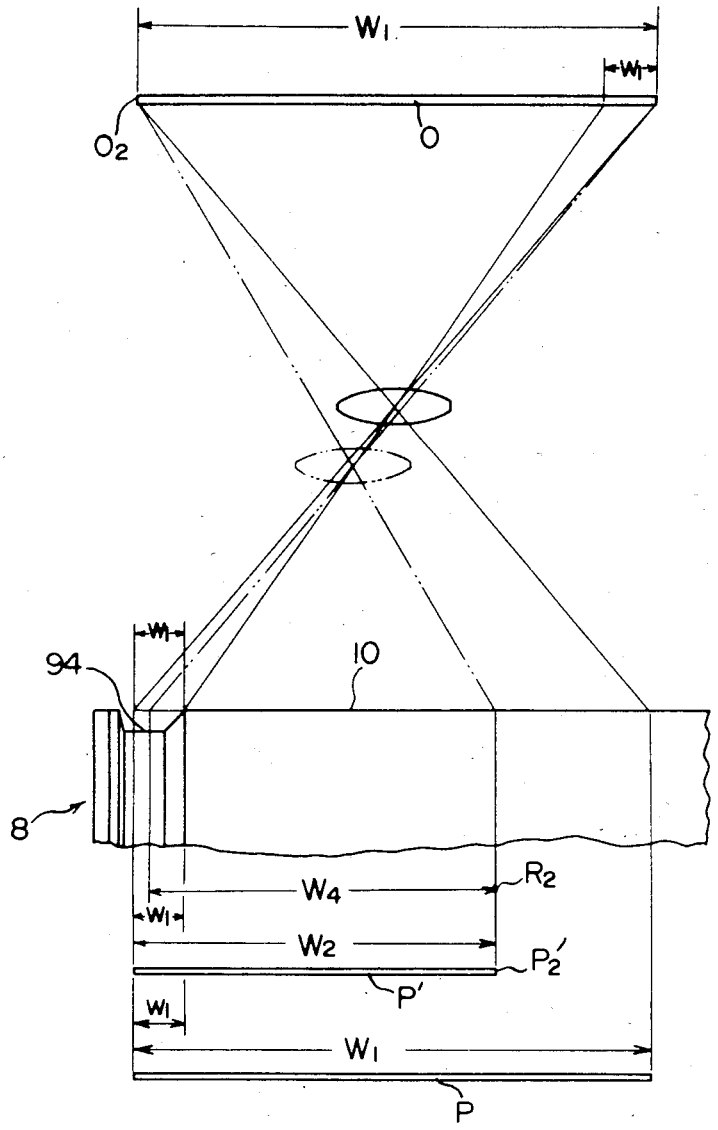

If the above method described with reference to FIG. 4 is employed, there will of course be some difference between the ratio M of the width $W_2$ of the copying paper P' to the width $W_1$ of the original document O and the ratio M'(M''') of the copied image formed on the copying paper P' to the image of the original document O. Since, however, such a difference corresponds to the slight width x mentioned above and is extremely small, it does not render the copied image unnatural. In contrast, since the corresponding difference in the method disclosed in the above-cited Japanese Laid-Open Patent Publication No. 28086/1980 corresponds to a predetermined width $w_1$ ($w_1$ x), it is considerably large and renders the copied image unnatural.

Mounting and Moving Mechanisms for the Optical Device

The copying apparatus of the invention illustrated in FIG. 1 is constructed such that it can perform a copying process at two or more selectively prescribed ratios, more specifically in a substantially equal scale mode or in a reduced scale mode at a predetermined ratio (for example, about 0.7 in length and about 0.5 in area). As already stated hereinabove, when the copying process is performed in a substantially equal scale mode, the optical device 66 projects the image of an original document placed on the transparent plate 4 onto the photosensitive member 10 disposed on the peripheral surface of the rotating drum 8 substantially at a ratio of 1. In a reduced scale mode at a predetermined ratio of copying, the optical device 66 projects the image of the original document placed on the transparent plate 4 at the above-mentioned predetermined ratio onto the photosensitive member 10 disposed on the peripheral surface of the rotating drum 8.

When the image of the original document placed on the transparent plate 4 is to be projected onto the photosensitive member 10 substantially at a ratio of 1, the constituent elements of the optical device 66 are positioned as shown in FIG. 1. In contrast, when the image of the original document placed on the transparent plate 4 is to be projected on a reduced scale at a predetermined ratio onto the photosensitive member 10, some of the constituent elements of the optical device 66 (in the illustrated embodiment, the lens assembly 78, the second reflectin9 mirror 74 and the third reflecting mirror 76) are moved as prescribed. The lens assembly 78 is moved in a direction inclined at a predetermined angle to the optical axis of the optical device 66, and is thus caused to approach the photosensitive member 10, in order to position the reduced projected image, for example, as described hereinabove with reference to FIG. 3 or 4 with respect to the photosensitive member 10. The second reflecting mirror 74 and the third reflecting mirror 76 are moved away slightly from the lens assembly 78 so that even when the lens assembly 78 is caused to approach the photosensitive member 10, the focal distance f of the lens placed in the lens assembly 78, the distance a between the lens and the original document placed on the transparent plate 4, and the distance b between the lens and the photosensitive member 10 are maintained in the relation $1/f=1/a+1/b$.

Figure 5:
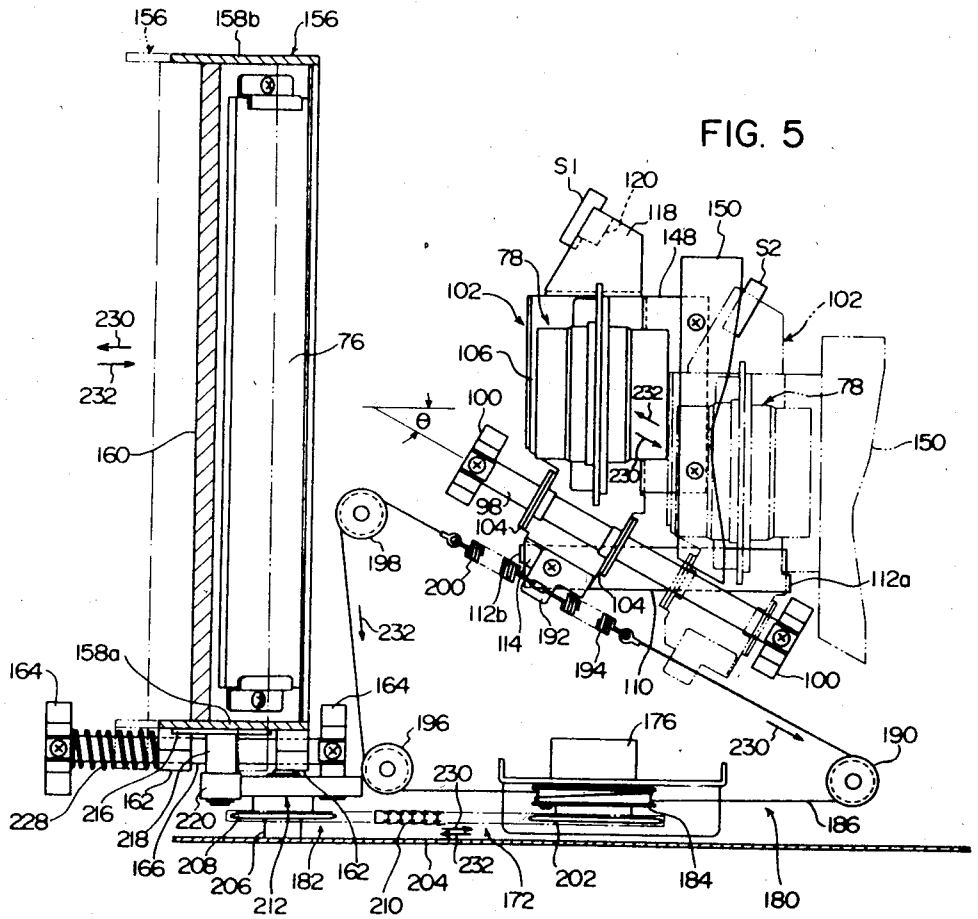
FIG. 5 is a partial sectional view showing the principal parts of an optical device used in the copying apparatus shown in FIG. 1.
Figure 6:
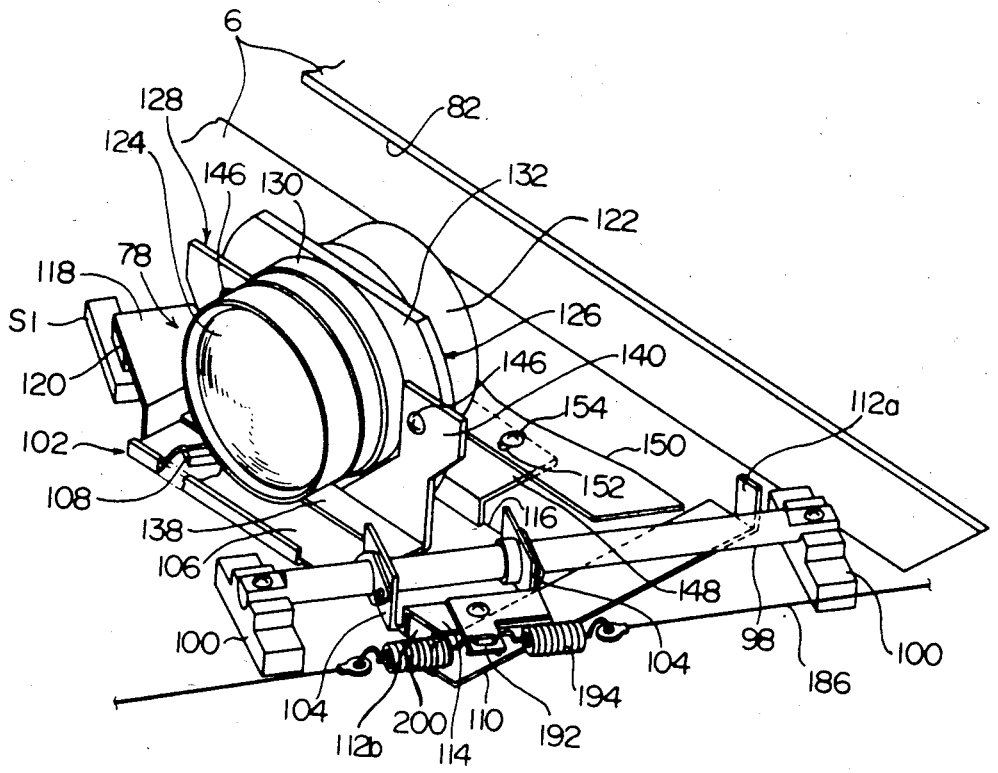
FIG. 6 is a partial perspective view showing one supporting frame of the optical device used in the copying apparatus shown in FIG. 1 and its related elements.

One example each of mounting and moving mechanisms for achieving the change of the positions of some of the constituent elements of the optical device 66 (in the illustrated embodiment, the lens assembly 78, the second reflecting mirror 74 and the third reflecting mirror 76) according to the ratio of copying will be described below with reference to FIGS. 5, 6 and 7 taken in conjunction with FIG. 1. To the upper surface of the horizontal base plate 6 (FIGS. 1, 6 and 7) disposed within the housing 2 (FIG. 1) is fixed by means of a pair of mounting blocks 100 an inclined guide rod 98 extending inclinedly at an angle $\theta$ (FIG. 5) with respect to the optical axis of the optical device 66 which extends in the left and right directions in FIGS. 1, 5 and 7. A pair of upstanding pieces 104 formed at one side portion of the supporting frame 102 for the lens assembly 78 are slidably mounted on the inclined guide rod 98. As can be seen from FIG. 7, the under surface of a main portion 106 of the supporting frame 102 is separated some distance from the upper surface of the horizontal base plate 6, and at the under surface of the main portion 106 is formed a supporting block 108 which is in contact with the upper surface of the horizontal base plate 6 and when the supporting frame 102 is moved along the inclined guide rod 98, is caused to slide over the upper surface of the horizontal base plate 6. Hence, the supporting frame 102 is accurately supported in the desired condition when its pair of upstanding pieces 104 are mounted on the inclined guide rod 98 and the supporting block 108 comes into contact with the upper surface of the horizontal base plate 6. In relation to the supporting frame 102, a position-setting member 110 is also fixed to the horizontal base plate 6, and upstanding stop pieces **112*a* and 112*b* are formed at opposite ends of the position-setting member 110. When the supporting frame 102 is held at the equal scale position shown by a solid line in FIGS. 5 to 7 (as will be described below, when the supporting frame 102 is held at this equal scale position, the optical device 66 projects the image of an original document substantially at a ratio of 1 onto the photosensitive member 10), the edge of a projecting piece 114 formed at one side portion of the supporting frame 102 abuts against the stop piece 112***b* as shown in FIGS. 5 and 6. On the other hand, when the supporting frame 102 is held at the reduced scale position shown by a two-dot chain line in FIGS. 5 and 7 (as will be stated below, when the supporting frame 102 is held at this reduced scale position, the optical device 66 projects the image of the original document on a reduced scale at a predetermined ratio onto the photosensitive member 10), a part 116 (FIG. 6) of the front edge of the main portion 106 of the supporting frame 102 abuts against the stop piece 112*a*. A projecting piece 118 is formed at the other side edge portion of the supporting frame 102, and a permanent magnet 120 is fixed to the under surface of the projecting piece 118. In relation to the permanent magnet 120, detecting switches S1 and S2 for detecting the permanent magnet 120 are provided on the horizontal base plate 6. Furthermore, as will be described in greater detail hereinafter, the detecting switch S1 detects the permanent magnet 120 when the supporting frame 102 is held at the aforesaid equal scale position or its vicinity, and the detecting switch S2 detects the permanent magnet 120 when the supporting frame 102 is held at the aforesaid reduced scale position or its vicinity.

Figure 8:
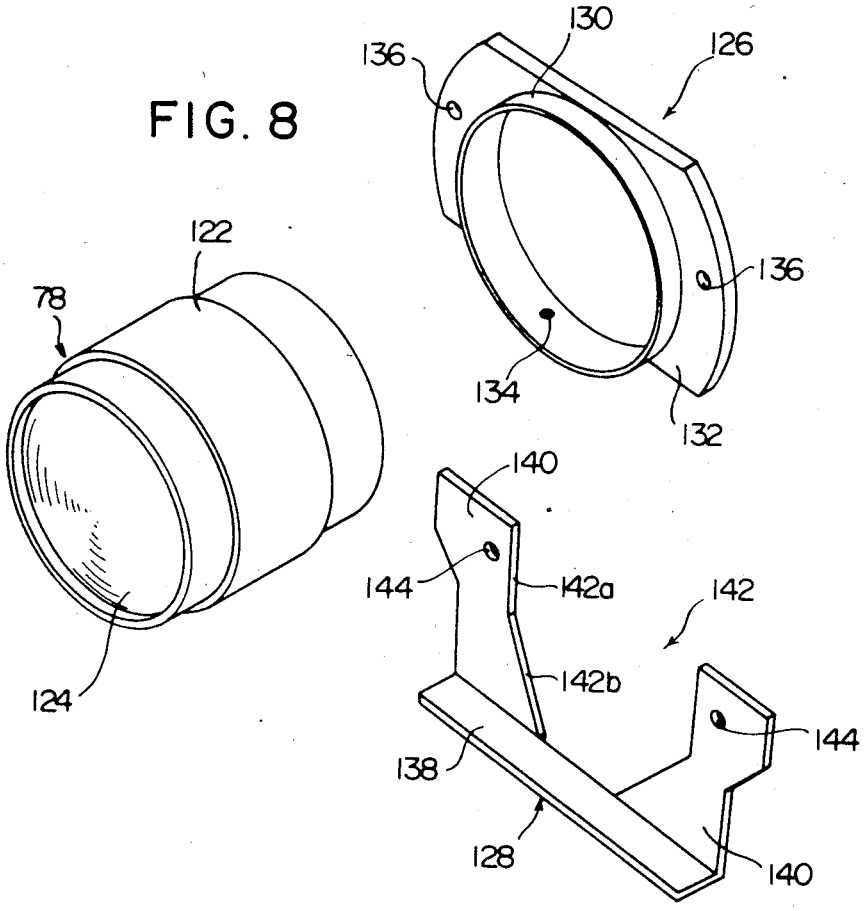
FIG. 8 is an exploded perspective view showing a lens assembly in the optical device used in the copying apparatus shown in FIG. 1 and members used to mount the lens assembly.
Figure 9:
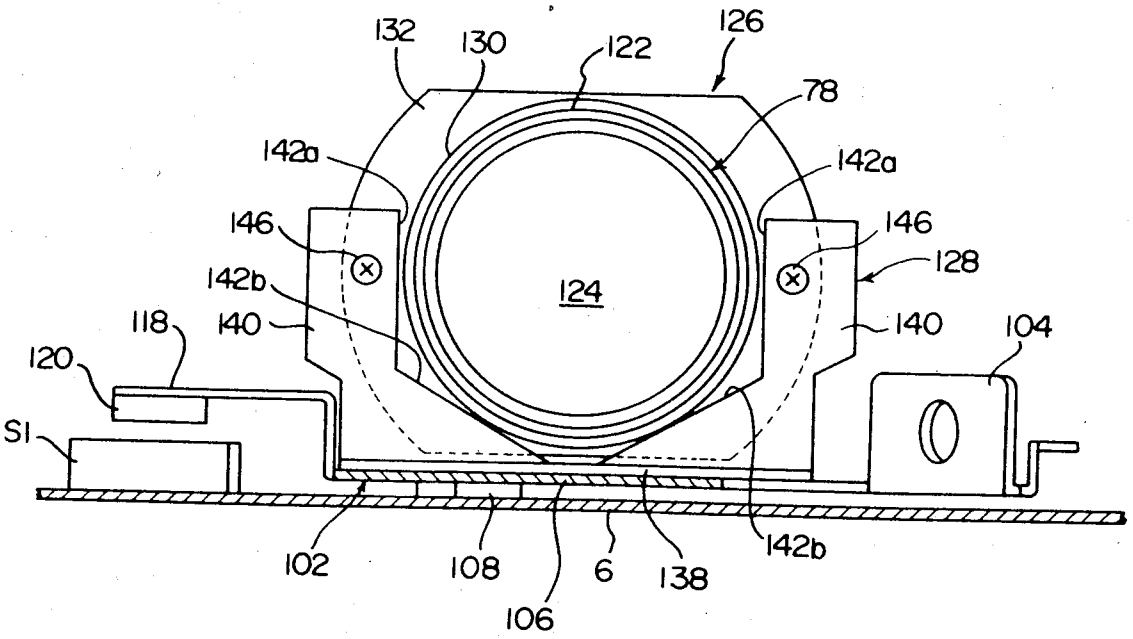
FIG. 9 ia a partial sectional view showing the mode of mounting a lens assembly in the optical device used in the copying apparatus shown in FIG. 1.

The lens assembly 78 of the optical device 66 is mounted on the supporting frame 102 as prescribed. The mechanism of mounting the lens assembly 78 on the supporting frame 102 will be described with reference to FIGS. 8 and 9 taken in conjunction with FIG. 6. The lens assembly 78 is comprised of a substantially hollow cylindrical lens housing 122, and one or more (usually a plurality of) lenses 124 placed in the lens housing 122. In order to mount the lens assembly 78 on the supporting frame 102 as prescribed, a linking member 126 and a supporting member 128 are used in the illustrated embodiment. The linking member 126 has a hollow cylindrical portion 130 having an inside diameter corresponding to the outside diameter of the lens housing 122 of the lens assembly 78 and a flange portion 132 projecting from the cylindrical portion 130 radially toward both sides. A radially extending screw hole 134 is formed in the cylindrical portion 130, and a pair of axially extending screw holes 136 are formed in the flange portion 132. The linking member 126 is fixed to the lens assembly 78 by fitting it over a given position of the central part of the lens housing 122, threadably inserting a setscrew (not shown) through the screw hole 134, and causing the end of the setscrew to abut against the surface of the lens housing 122, or threadably fitting it with a corresponding screw hole (not shown) formed in the lens housing 122. On the other hand, the supporting member 128 has a base portion 138 and a projecting supporting piece 140 upstanding from the base portion 138. In the projecting supporting piece 140 is formed a relatively large notch 142 extending from its upper end edge to its lower end edge. The notch 142 has an introductory portion 142*a* extending downwardly from the upper end edge of the projecting supporting piece 140 with a slightly larger width than the outside diameter of the cylindrical portion 130 of the linking member 126 and a tapering portion 142*b* extending downwardly from the introductory portion 142*a* in a tapering manner. A pair of throughholes 144 located on the opposite sides of the notch 142 are formed in the projecting supporting piece 140. The supporting member 128 is fixed to the supporting frame 102 by fixing its base portion 138 to the upper surface of the main portion 106 of the supporting frame 102 by a suitable method such as welding or screwing. In mounting the lens assembly 78 having the linking member 126 fixed thereto on the supporting frame 102 having the supporting member 128 fixed thereto, the lens assembly 78 is inserted through the introductory portion 142*a* of the notch 142 and set on the tapering portion 142*b*, and as shown in FIG. 9, the peripheral surface of the cylindrical portion 130 of the linking member 126 is placed on the side edges of the tapering portion 142*b*. Then, the flat one surface of the flange portion 132 of the linking member 126 is contacted with the adjoining flat one surface of the projecting supporting piece 140. Set screws 146 are screwed into the pair of screw holes 136 formed in the flange portion 132 of the linking member 126 through the pair of through-holes 144 formed in the projecting supporting piece 140. Thus, the lens assembly 78 is fixed to the projecting supporting piece 140. According to the above-described mounting mechanism using the linking member 126 and the supporting member 128, the peripheral surface of the cylindrical portion 130 of the linking member 126 is brought substantially into point-to-point or line-to-line contact with both side edges of the tapering portion 142*b* of the notch 142 thereby accurately defining the vertical and lateral positions of the lens assembly 78 with respect to the supporting frame 102. Furthermore, the flat one surface of the flange portion 132 of the linking member 126 is contacted with the adjoining one flat surface of the projecting supporting piece 140, thereby accurately defining the axial position of the lens assembly 78 with respect to the supporting frame 102 and also accurately positioning the axis of the lens assembly 78 with respect to the supporting frame 102 as prescribed (more specifically, so that it extends perpendicularly to the projecting supporting piece 140). Accordingly, without expertise, the lens assebly 78 can be mounted as prescribed onto the supporting frame 102 with relative simplicity and ease. If desired, it is possible to form the linking member 126 as a unit with the lens housing 122 of the lens assembly 78 and to form the projecting supporting piece 140 as a unit with the supporting frame 102. It is also possible to omit the cylindrical portion 130 of the linking member 126 and to place the peripheral surface of the lens housing 122 directly onto the tapering portion 142*b* of the notch 142 in the projecting supporting member 140.

Figure 7:
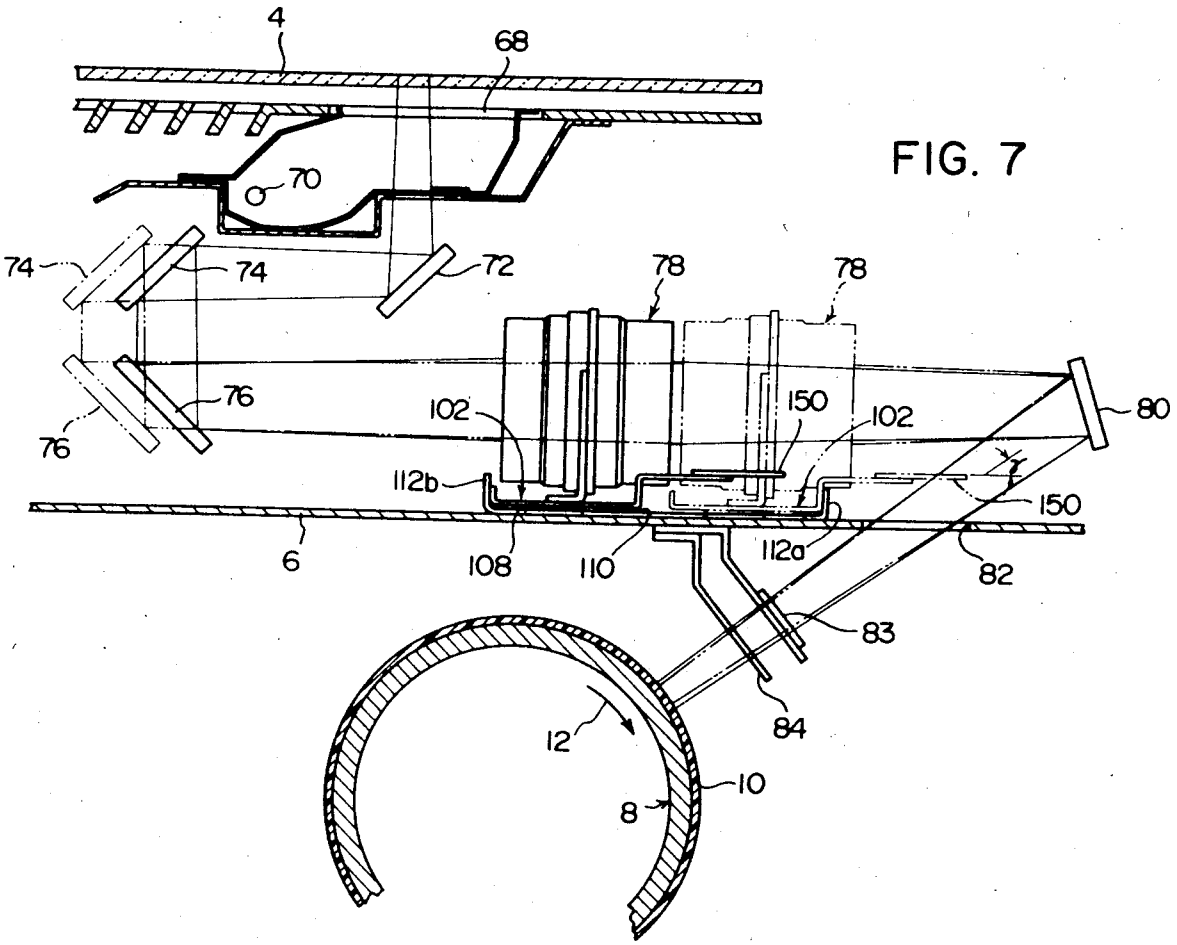
FIG. 7 is a sectional view showing a part of the copying apparatus shown in FIG. 1.

As shown in FIGS. 5, 6 and 7, a projecting piece 148 is formed at one end portion (the right end portion in FIGS. 5 and 7) of the supporting frame 102, and an exposure adjusting plate 150 is mounted on the projecting piece 148. A pair of laterally spaced slots 152 (only one of them is shown in FIG. 6) are formed in the exposure adjusting plate 150. By screwing setscrews 154 into the projecting piece 148 through these slots 152, the exposure adjusting plate 150 is mounted on the projecting piece 148 such that its position can be freely adjusted (namely, the amount of the plate 150 projecting from the projecting piece 148 can be adjusted freely). The configuration, operation, effect, etc. of the exposure adjusting plate 150 itself will be described hereinafter in greater detail.

Figure 10:
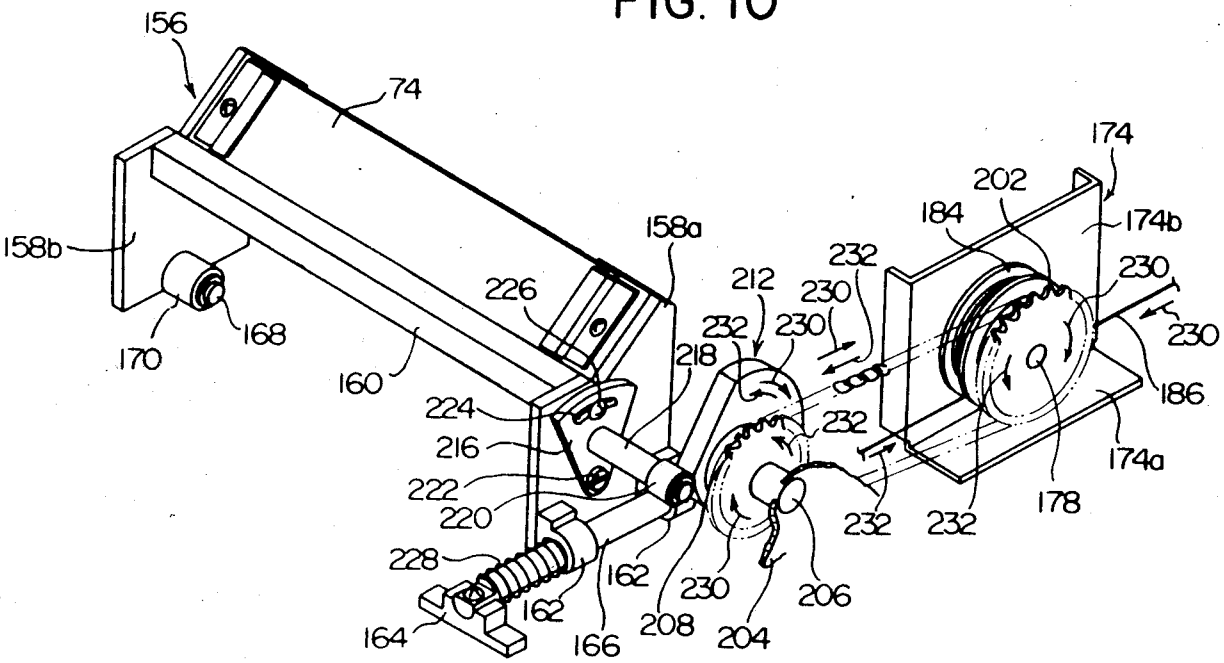
FIG. 10 is a partial perspective view showing the other supporting frame of the optical device used in the copying apparatus shown in FIG. 1 and its related elements.

With reference to FIGS. 5 and 10, a supporting frame 156 is also mounted on the horizontal base plate 6 (FIGS. 1, 6 and 7) in addition to the supporting frame 102. The supporting frame 156 has a pair of laterally spaced side plates 158*a* and 158*b* and a member 160 connected between the pair of side plates 158*a* and 158*b*. Furthermore, the second reflecting mirror 74 and the third reflecting mirror 76 (FIGS. 1 and 7) of the optical device 66 are mounted as prescribed between the pair of side plates 158*a* and 158*b*. A pair of linking brackets 162 are secured to the outside surface of the side plate 158*a*. On the other hand, a guide rod 166 extending substantially parallel to the optical axis of the optical device 66 is fixed to the horizontal base plate 6 (FIGS. 1, 5 and 7) by means of a pair of fixing blocks 164. The above pair of linking brackets 162 are slidably linked to the guide rod 166. A short shaft 168 is fixed firmly in the inside surface of the side plate 158*b*, and a roller 170 above the horizontal base plate 6 is rotatably mounted on the short shaft 168 (see FIGS. 11-A and 11-B also). The supporting frame 156 can be moved along the guide rod 166 when the pair of linking brackets 162 slide with respect to the guide rod 166 and the roller 170 rotates over the horizontal base plate 6. As will be described in greater detail, the supporting frame 156 is selectively held at the equal scale position shown by a solid line in FIG. 5 and also in FIG. 10 (as will be stated hereinafter, when the supporting frame 156 is held at this equal scale position, the optical device 66 projects the image of an original ducument onto the photosensitive member 10 substantially at a ratio of 1), and the reduced scale position shown by a two-dot chain line in FIG. 5 (as will be stated hereinafter, when the supporting frame 156 is held at this reduced scale position, the optical device 66 projects the image of the original document onto the photosensitive member 10 on a reduced scale at a predetermined ratio).

The optical device 66 also has a moving mechanism shown generally at 172 for selectively holding the supporting frame 102 and the supporting frame 156 at the aforesaid equal scale position and the reduced scale position.

As shown in FIGS. 5 and 10, provided on the horizontal base plate 6 (FIGS. 1, 6 and 7) is a mounting member 174 having a base portion 174*a* fixed to the horizontal base plate 6 and a mounting portion 174*b* upstanding from the base portion 174*a*, and a drive source constructed of a reversible electric motor 176. In the illustrated embodiment, the reversible motor 176 has an output shaft 178 projecting forwardly in FIG. 10 through the mounting portion 174*b* of the mounting member 174, and the output shaft 178 constitutes an input shaft of the moving mechanism 172. Needless to say, it is possible, if desired, to mount a separate input shaft for the moving mechanism 172 rotatably, and drivingly connect the input shaft to the reversible motor 176. The moving mechanism 172 further includes a first moving arrangement 180 for moving the supporting frame 102 according to the rotation of the shaft 178 and a second moving arrangement 182 for moving the supporting frame 156 according to the rotation of the shaft 178.

With reference to FIGS. 5 and 10 taken in conjunction with FIG. 6, the first moving arrangement 180 includes a pulley 184 fixed directly to the shaft 178, and a rope 186, conveniently a wire rope, is wrapped about the pulley 184 through nearly one turn. As will be described hereinafter, the pulley 184 is rotated between the angular position shown in FIG. 11-A and the angular position shown in FIG. 11-B by the reversible electric motor 176. Conveniently, in order to prevent generation of slippage between the pulley 184 and the rope 186 during this rotation of the pulley 184, that part of the rope 186 which does not separate from the pulley 184 is accurately fixed to the pulley 184 by means of a setscrew 188 (FIGS. 11-A and 11-B). One side of the rope 186 wrapped about the pulley 184 extends along a rotatably mounted guide pulley 190 and is connected by means of a tension spring 194 to a linking piece 192 fixed to the projecting piece 114 formed at one side portion of the supporting frame 102. The other side of the rope 186 wrapped about the pulley 184 extends along rotatably mounted guide pulleys 196 and 198 and is connected by means of a tension spring 200 to the linking piece 192 fixed to the supporting frame 102. The guide pulleys 190 and 198 guide the rope 186 so that it extends substantially parallel to the inclined guide rod 98 between the guide pulley 190 and the linking piece 192 and between the linking piece 192 and the guide pulley 198.

The second moving arrangement 182 will be described with reference to FIGS. 11-A and 11-B taken in conjunction with FIGS. 5 and 10. The second moving arrangement 182 includes a wheel 202, conveniently a sprocket wheel, directly fixed to the shaft 178. A short shaft 206 is fixed to one of a pair of side plates 204 disposed in laterally spaced apart relationship within the housing 2 (FIG. 1) (the horizontal base plate 6 is disposed between this pair of side plates), and a wheel 208, conveniently a sprocket wheel, is rotatably mounted on the short shaft 206. A wrapping power transmission member 210, conveniently a chain, is wrapped about the wheels 202 and 208, and a cam 212 to be rotated as a unit with the wheel 208 is also mounted on the short shaft 206. The cam 212 is comprised of a cam plate having on its peripheral surface two arcuate acting surfaces having different radii, i.e., a small-radius acting surface 214*a* and a large-radius acting surface 214*b*, and a transit surface 214*c* located between the two acting surfaces on its peripheral surface. A fan-like member 216 is mounted on the outside surface of the side plate 158*a* of the supporting frame 156, and a short shaft 218 is fixed into the fan-like member 216, and a roller 220 constituting a cam follower is rotatably mounted on the end portion of the short shaft 218. The lower end portion of the fan-like member 216 is pivotably linked to the side plate 158*a* by a linking pin 222 and a setscrew 226 is screwed into the side plate 158*a* through an arcuate slit 224 having its center at the linking pin 222. As a result, the fan-like member 216 is mounted on the side plate 158*a* so that its angular position of pivoting about the linking pin 222 as a center can be freely abjusted. It will be appreciated that when the pivoting angular position of the fan-like member 216 with respect to the side plate 158*a* is changed, the position of the roller 220 in the longitudinal direction of the guide rod 166 with respect to the supporting frame 156 will be changed. In relation to the supporting frame 156, the guide rod 166 has also mounted thereon a compression spring 228 one end of which acts on one of the pair of fixing blocks 164 and the other of which acts on one of the pair of linking brackets 162. The compression spring 228 elastically urges the supporting frame 156 toward the right in FIGS. 11-A and 11-B, and elastically presses the roller 220 constituting the cam follower against the periperal surface of the cam 212.

The operation of the moving mechanism 172 described hereinabove is summarized below.

For example, in moving the supporting frames 102 and 156 from the equal scale position shown by a solid line in FIG. 5 to the reduced scale position shown by a two-dot chain line in FIG. 5, the reversible electric motor 176 is rotated normally to rotate the shaft 178 in the directoin of an arrow 230 (FIGS. 10 and 11-A). As a result, the pulley 184 of the first moving arrangement 180 is rotated in the direction of arrow 230. When the pulley 184 is rotated in the direction of arrow 230, the rope 186 is moved in the direction of arrow 230, and thus the supporting frame 102 is moved in the direction of arrow 230. When the supporting frame 102 is moved to the reduced scale position shown by the two-dot chain line in FIG. 5, the part 116 of the front edge of the main portion 106 of the supporting frame 102 is caused to abut against the stop piece 112*a*. On the other hand, when the supporting frame 102 is moved to the reduced scale position or its vicinity, the detecting switch S2 detects the permanent magnet 120 fixed to the supporting frame 102. As will be described in detail hereinafter, even when the detecting switch S2 has detected the permanent magnet 120, the reversible motor 176 is not deenergized; but it is deenergized after the lapse of a predetermined delay time from the time when the detecting switch S2 detected the permanent magnet 120. Accordingly, after the supporting frame 102 has abutted against the stop piece 112*a*, the reversible motor 176 continues to be in the energized state for a certain period of time. As a result, the supporting frame 102 cannot further move in the direction of arrow 230, whereas a force tending in the direction of arrow 230 acts on the rope 186 to stretch the tension spring 194 elastically. Thus, the supporting frame 102 is pressed elastically against the stop piece 112*a* by the action of the tension spring 194 and thereby accurately held at the required reduced scale position.

When the reversible electric motor 176 is normally rotated to rotate the shaft 178 in the direction of arrow 230 (FIGS. 10 and 11-A), the wheel 202 of the second moving arrangement 182 is also rotated in the direction of arrow 230, and the wheel 208 is rotated in the direction of arrow 230 through the wrapping power transmission member 210. Incident to the rotation of the wheel 208, the cam 212 is rotated in the direction of arrow 230 from the position shown in FIG. 11-A, and when the reversible motor 176 is deenergized, the cam 212 is held at its angular position at which the large-radius acting surface 214*b* acts on the roller 220 forming the cam follower, as shown in FIG. 11-B. When the cam 212 is rotated from the angular position shown in FIG. 11-A to the angular position shown in FIG. 11-B, the action of the cam 212 causes the supporting frame 156 to move from the equal scale position shown in FIG. 11-A to the reduced scale position shown in FIG. 11-B against the elastic biasing action of the compression spring 228, and is thus held accurately at the reduced scale position shown in FIG. 11-B. When the reversible motor 176 is deenergized, the cam 212 needs not to be precisely held at its predetermined angular position, and so long as the large-radius acting surface 214*b* of the cam 212 is positioned in an angular range in which it acts on the roller 220, the supporting frame 156 is accurately held in the required reducing position.

In moving the supporting frames 102 and 156 from the reduced scale position shown by the two-dot chain line in FIG. 5 to the equal scale position shown by the solid line in FIG. 5, the reversible electric motor 176 is reversely rotated to rotate the shaft 178 in the direction shown by an arrow 232 (FIGS. 10 and 11-B). As a result, the pulley 184 of the first moving arrangement 180 is rotated in the direction of arrow 232. When the pulley 184 is rotated in the direction of arrow 232, the rope 186 is moved in the direction of arrow 232, and as a result, the supporting frame 102 is moved in the direction of arrow 232. When the supporting frame 102 is moved to the equal scale position shown by the solid line in FIG. 5, the edge of the projecting piece 114 formed in one side portion of the supporting frame 102 is caused to abut against the stop piece 112*b*. On the other hand, when the supporting frame 102 is moved to the equal scale position or its vicinity, the detecting switch S1 detects the permanent magnet 120 fixed to the supporting frame 102. As described in more detail hereinafter, however, even when the detecting switch S1 has detected the permanent magnet 120, the reversible motor 176 is not deenergized; but it is deenergized after the lapse of a certain period of delay time from the time when the detecting switch S1 detected the permanent magnet 120. Accordingly, even after the supporting frame 102 has abutted against the stop piece 112*b*, the reversible motor 176 continues to be in the energized state for a certain period of time. As a result, the supporting frame 102 cannot be moved further in the direction of arrow 232, whereas a force tending in the direction of arrow 232 acts on the rope 186 to stretch the tension spring 200 elastically. By the action of the tesion spring 200, the supporting frame 102 is pressed elastically against the stop piece 112*b* and thereby held accurately at the required equal scale position.

On the other hand, when the reversible electric motor 176 is rotated reversely to rotate the shaft 178 in the direction of arrow 232 (FIGS. 10 and 11-B), the wheel 202 of the second moving arrangement 182 is rotated in the direction of arrow 232, and the wheel 208 is rotated in the direction of arrow 232 through the wrapping power transmission member 210. Incident to the rotation of the wheel 208, the cam 212 is rotated in the direction of arrow 232 from the position shown in FIG. 11-B, and when the reversible motor 176 is deenergized, the cam 212 is held at an angular position at which its small-radius acting surface 214*a* acts on the roller 220 constituting the cam follower. When the cam 212 is rotated from its angular position shown in FIG. 11-B to its angular position shown in FIG. 11-A, the supporting frame 156 is moved from the reduced scale position shown in FIG. 11-B to the equal scale position shown in FIG. 11-A by the elastic biasing action of the compression spring 228, and is thus accurately held at the equal scale position shown in FIG. 11-A. In the case of holding the supporting frame 156 at the equal scale position, too, the cam 212 needs not to be precisely held at its predetermined position at the time when the reversible motor 176 has been deenergized. So long as the small-radius acting surface 214*a* of the cam 212 is held in an angular range in which it acts on the roller 220, the supporting frame 156 is accurately held at the required equal scale position.

The moving mechanism 172 provided in the optical device 66 has excellent advantages, among which are:

(a) Since the rope 186 is utilized to move the supporting frame 102 whose moving distance is relatively large and the cam 212 is utilized to move the supporting frame 156 whose moving distance is relatively small, the supporting frames 102 and 156 which have to be moved in different directions can be moved in the required relationship by a relatively simple and inexpensive mechanism having a single drive source (i.e., the reversible electric motor 176);

(b) It is extremely difficult, if not impossible, to precisely prescribe the time of deenergization of the drive source (i.e., the reversible motor 176). According to the above moving mechanism, the supporting frames 102 and 156 can be accurately held at the required positions (i.e., the equal scale position and the reduced scale position) even if a considerable error exists in the time of deenergization of the drive source.

Exposure adjusting plate

The illustrated copying apparatus of this invention is constructed such that the copying process can be performed at selectively prescribed two or more ratios of copying, more specifically in a substantially equal scale mode and a reduced scale mode at a predetermined ratio (e.g., about 0.7 in length and about 0.5 in area). In this type of copying apparatus, when substantially equal scale copying is changed to reduced scale (or enlarged scale) copying at a predetermined ratio, the amount of exposure on the photosensitive member 10 changes. In order, therefore, to obtain a good copied image in the case of the reduced (or enlarged) scale copying, it is important to adjust the amount of exposure on the photosensitive member 10 properly in changing the substantially equal scale copying to the reduced (or enlarged) scale copying at a predetermined ratio.

FIG. 12-A diagrammatically shows the projection of an original document O onto the photosensitive member 10 as a projected image I on a substantially equal scale by means of a lens L. It is well known to those skilled in that art that in the projected state shown in FIG. 12-A, light from a point p on the original document O which falls at an incidence angle of $\alpha$ to the lens L is decayed to $\cos^4\alpha$ times at point p' on the projected image I owing to the widthwise light decaying property of the lens L. In order, therefore, to make the distribution of illuminance in the widthwise direction at the projected image I substantially uniform by adjusting the light decaying property of the lens L, the specific illuminance $Z_p$ at point p of the original document O should be adjusted to a value given by the following equation.

$$Z_{p(x)} = 1/\cos^4\alpha \tag{1}$$

$$= 1/\cos\left(\tan^{-1}\frac{\left|\frac{B}{2} - x\right|}{2f}\right)^4$$

wherein f is the focal distance of the lens L,

B is the total width of the original document O, and x is the distance from one side edge of the document O to the point p.

In order to satisfy this requirement, the document illuminating lamp 70 (FIGS. 1 and 7) of the optical device 66 in the illustrated copying apparatus is constructed such that its brightness is gradually increased from its center in the widthwise direction toward its side end as is well known, and it illuminates the document O placed on the transparent plate 4 (FIGS. 1 and 7) at the illuninance defined by equation (1) above thereby to offset the widthwise decaying property of the lens L and to make the distribution of illuminance of the projected image I in the widthwise direction substantially uniform. Thus, in the case of performing substantially equal scale copying, the width, in the moving direction of the photosensitive member 10 (the moving direction of the transparent plate 4), namely the slit exposure width, of a light path leading from the original document O to the photosensitive member 10 may be substantially the same along the entire width of the photosensitive member 10. In the illustrated embodiment, the slit exposure width regulating member 84 (FIGS. 1 and 7) defining the slit exposure width between the lens L and the photosensitive member 10 defines the slit exposure width which is substantially the same along the entire width of the photosensitive member 10.

When the copying process is carried out in a reduced (or enlarged) scale mode at a predetermined ratio M, the lens assembly 78 of the optical device 66 in the illustrated copying apparatus is moved in a direction inclined at a predetermined angle with respect to the optical axis of the optical device 66. Hence, the state of projecting the original document O onto the photosensitive member 10 as a projected image I on a reduced (or enlarged) scale at a predetermined ratio M by the lens L is as shown diagrammatically in FIG. 12-B. In order to simplify the description, FIG. 12-B shows the case in which as described hereinabove with reference to FIG. 2, the reduced (or enlarged) projected image I is positioned widthwise such that its one side edge corresponds with one side edge of the projected image I on an equal scale (accordingly, some correction is required as described below when the projected image I is positioned widthwise as described above with reference to FIGS. 3 and 4).

Variations in the illuminance of the projected image I in the state shown in FIG. 12-B will now be considered. Firstly, when variations in illuninace owing to the widthwise displacement of the optical axis of the lens L are considered, the specific illuminance at point p' of the projected image I corresponding to the point p of the original document O changes to the value defined by the following equation (2) owing to the widthwise displacement of the optical axis of the lens L in regard to the specific illuminance $Z_{p(x)}$ in the equal scale projection of the image of the document O.

$$Z_{1p'(x)} = Z_{p(x)}\cos\left(\tan^{-1}\frac{|F - G|}{D}\right)^4 \tag{2}$$

In the above equation (2), D is the distance between the lens L and the projected image I and is exressed by $$D = f(1+M).$$

F is the distance from one side edge of the projected image I to the optical axis of the lens L and expressed by the following formula.

$$F = B(1 + M)/\left(M + \frac{1}{M} + 2\right)$$

$$= \frac{BM}{1 + M}$$

G is the distance from one side edge of the projected image I to point p', and expressed by $G=M(B-x)$.

Secondly, since the projected image I is M times the size of the original document O, the point p' of the projected image I collects light in an amount $4/(1+M)^2$ times that in the case of the substantially equal scale projection. Hence, owing to the projection at a ratio of M, the illuminance of the point p' of the projected image I changes to the value shown by the following equation (3) with regard to the specific illuminance $Z_{p(x)}$ which is obtained in the case of the substantially equal scale projection.

$$Z_{2p'(x)} = Z_{p(x)} \cdot \frac{4}{(1+M)^2} \tag{3}$$

When the copying is carried out at a predetermined ratio M, the speed of slit exposure is changed to 1/M times the speed employed in the case of the substantially equal scale copying. Specifically, in the illustrated embodiment, the moving speed of the transparent plate 4 (the moving speed of at least a part of the optical device in a copying apparatus of the type in which slit exposure is carried out by moving at least a part of the optical device instead of moving the transparent plate) is changed to 1/M times that employed in the case of the substantial equal scale copying. Accordingly, the exposure time changes to M times that employed in the case of the substantially equal scale copying. However, as shown in FIGS. 1 and 7, when the exposure width is regulated between the lens L and the photosensitive member 10 by the slit exposure width regulating member 84, the optical slit exposure width based on the original document O is changed to 1/M times that in the case of the substantially equal scale copying according to the predetermined ratio M. This change in the optical slit exposure width offsets the change in the exposure time. On the other hand, when the slit exposure width is regulated between the original document O and the lens L, the optical slit exposure width based on the original document does not change even when the ratio M changes. Hence, owing to the change of the exposure time to M times that in the case of the substantrally equal scale copying, the specific illuminance at p' of the projected image I changes to the value shown by the following equation (4) as compared with the case of the substantially equal scale copying.

$$Z_{3p'(x)}=Z_{p(x)}\cdot M \tag{4}$$

Hence, when the slit exposure width is regulated between the lens L and the photosensitive member 10, the specific illuminance $Z_{p'(x)}$ of point p' of the projected image I projected at a predetermined ratio M changes to the value expressed by the following equation (5) as compared with the case of the substantially equal scale copying because of the changes represented by the above equations (2) and (3).

$$Z_{p'(x)} = Z_{p(x)}\cos\left(\tan^{-1}\frac{|F-G|}{D}\right)^4 \cdot \frac{4}{(1+M)^4} \tag{5}$$

When the slit exposure width is regulated between the original document O and the lens L, the illuminance changes to the value given by the following equation (6) as compared with the case of the substantially equal scale copying because of the changes expressed by the above equations (2), (3) and (4).

$$Z_{p'(x)} = Z_{p(x)}\cos\left(\tan^{-1}\frac{|F-G|}{D}\right)^4 \cdot \frac{4}{(1+M)^4} \cdot M \tag{6}$$

When the copying process is carried out in a reduced (or enlarged) scale mode at a predetermined ratio M by adjusting the changes in illuminance expressed by equation (5) or (6), the illuminance of the projected image I in the widthwise direction is made substantially uniform in the following manner. Specifically, according to this invention, when the copying process is carried out in a reduced (or enlarged) scale mode at the predetermined ratio M, an exposure adjusting plate 150 (FIGS. 5, 6 and 7) is positioned in the light path between the lens L and the projected image I on the photosensitive member 10 or between the original document O and the lens L so as to change the slit exposure width; consequently, the amount of exposure of the point p' on the projected image I is made substantially the same as that in the case of the substantially equal scale copying. In other words, by changing the slit exposure width, the amount of exposure of the point p' on the projected image I is adjusted to $$1/\cos\left(\tan^{-1}\frac{|F-G|}{D}\right)^4 \cdot \frac{(1+M)^2}{4} \text{ times or}$$

$$1/\cos\left(\tan^{-1}\frac{|F-G|}{D}\right)^4 \cdot \frac{(1+M)^2}{4}\ 1/M \text{ times.}$$

The amount of decrease (or increase) of the slit exposure width for providing the aforesaid amount of exposure can be obtained by approximate calculation by a computer made for example according to the following theory. With reference to FIG. 13, it can be assumed that in practice the light leaving the lens L arrives at the projected image I while forming innumerable oblique cones. Suppose that the projected image I is equally divided into n portions (for the simplicity of description, it is divided into two equal portions in FIG. 13) in the direction of the slit exposure width (the up and down direction in FIG. 13), and the light leaving the lens L and forming (n+1) oblique cones arrives at the projected image I. If the slit exposure width is narrowed by v at a position apart from the lens L by distance y, a change in the total amount of light of the projected image I is determined by the ratio of the sum of the cross sectional areas of the oblique cones shut off by the exposure adjusting plate 150 to the sum total of the cross sectional areas of all oblique cones at the position at distance y. If n is taken as 2 for the simplicity of explanation, the radius r of each oblique cone at the position at distance y from the lens L is given by the following equation.

$$r = \left(1 - \frac{y}{D}\right) f/2N \tag{7}$$

Wherein N is the so-called F number of the lens L is expressed by $N=f/D$.

Thus, the total sum S' of the cross sectional areas shut off at the position at distance y from the lens L (the cross sectional areas of the hatched portions) is given by $S'=S_1+S_2+S_3$, and $$S_1 = \pi r^2,$$

$$S_2 = \int_{-r}^{v - H_2} \sqrt{r^2 - (x - H_2)^2}\, dx,$$

$$S_3 = 0.$$

As illustrated in FIG. 13, H represents the length from one end (the upper end in FIG. 13) of the slit exposure width at the position at distance y from the lens L to the center of each oblique cone. The total sum S of the ehtire cross sectional areas of the three oblique cones at distance y is given by $S=3\pi r^2$. Hence, by decreasing the slit exposure width by v, the ratio of total amount of light of the projected image I becomes $$\frac{S - S'}{S} = \frac{S - (S_1 + S_2 + S_3)}{S} = \frac{1}{3\pi r^2} \cdot \left[ 3\pi r^2 - \left( \pi r^2 + \int_{-r}^{v - H_2} \sqrt{r^2 - (x - H_2)^2}\, dx \right) \right]$$

times. On the basis of this theory, the v value can be calculated by a computer so that by making n sufficiently large, the value of S—S'/S approximates the aforesaid value $$1/\cos\left(\tan^{-1}\frac{|F - G|}{D}\right)^4 \cdot \frac{(1 + M)^2}{4}$$

(When the slit exposure width is changed between the lens L and the projected image I).

Figure 14:
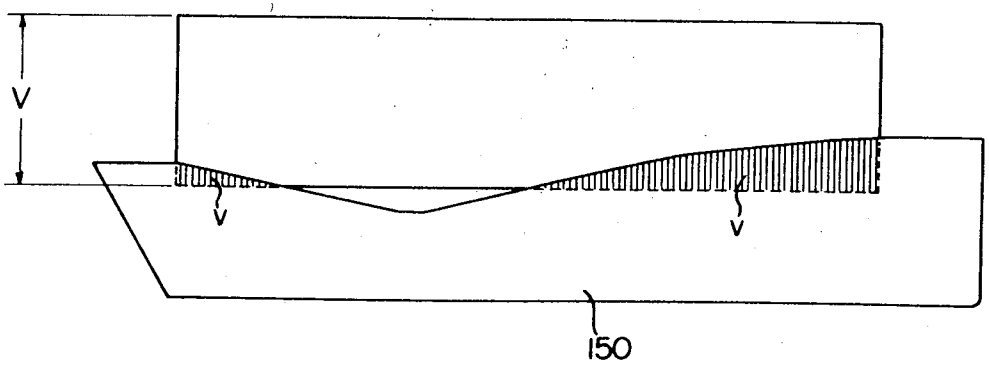
FIG. 14 is a top plan view of an exposure adjusting plate in the optical device used in the copying apparatus shown in FIG. 1.

As already stated hereinabove, in the illustrated copying apparatus, the exposure adjusting plate 150 is mounted on the supporting frame 102 on which the lens assembly 78 of the optical device 66 is also mounted. As can be easily seen from FIG. 7, when the supporting frame 102 is moved to the reduced scale position shown by the two-dot chain line in FIG. 7 in order to hold the lens assembly 78 at the reduced scale position, the exposure adjusting plate 150 is caused to advance into the light path between the lens assembly 78 and the photosensitive member 10, more specifically between the fourth reflecting mirror 80 and the opening 82 formed in the horizontal base plate 6, and is located partly in the light path. When the exposure adjusting plate 150 is held at the position shown by two-dot chain line in FIG. 7, the slit exposure width V regulated by the slit exposure width regulating member 84 (FIGS. 1 and 7) is partly narrowed by the partial shielding action of the exposure adjusting plate 150 as shown in FIG. 14 (the amount of narrowing, v, is prescribed as described above), and thus, the change in the amount of exposure expressed by equation (5) can be fully compensated for.

On the other hand, when the slit exposure width V employed in the substantially equal scale copying must be enlarged at least partly in order to compensate for the change in the amount of exposure expressed by equation (5) or (6) as in the case of enlarged scale copying, the restraining of at least one end of the slit exposure width by the regulating member 84 (FIGS. 1 and 7) is released, and the aforesaid at least one end of the slit exposure width is regulated by the exposure adjusting plate 150 to be partly positioned in the light path.

It is noteworty that in the illustrated copying apparatus constructed in accordance with this invention, the exposure adjusting plate 150 is mounted on the supporting frame 102 on which the lens assembly 78 is also mounted, and when the supporting frame 102 is moved to the position shown by the two-dot chain line in FIG. 7 in order to hold the lens assembly 78 in the reduced scale position, the exposure adjusting plate 150 is necessarily positioned in the light path, and therefore, no particular moving and positioning mechanism for the exposure adjusting plate 150 is required. It should also be noted that in the illustrated copying apparatus constructed in accordance with this invention, the exposure adjusting plate 150 is caused to advance into the light path by being moved not substantially perpendicularly to the optical axis but in a direction inclined thereto by a predetermined angle $\gamma$, as can be easily understood from FIG. 7. When the exposure adjusting plate 150 is moved into the light path inclinedly at a predetermined angle $\gamma$ to the optical axis, the amount of change in the slit exposure width relative to the amount of movement of the exposure adjusting plate 150 is relatively small, and therefore, the slit exposure width can be varied with sufficient accuracy even if tolerable errors (for example, tolerable errors in the configuration of the exposure adjusting plate 150 or the incoming position of the exposure adjusting plate 150) in regard to the amount of advancing of the exposure adjusting plate 150 into the light path in the case of reduced (or enlarged) scale copying are relatively large.

Control Circuit for Movement of the Optical Device

In the illustrated copying apparatus constructed in accordance with this invention, it is essential that the supporting frame 102 (and the lens assembly 78 and the exposure adjusting plate 150 mounted on it) and the supporting frame 156 (and the second reflecting mirror 74 and the third reflecting mirror 76 mounted on it) should be moved selectively from the equal scale position shown by the solid line in FIG. 5 to the reduced scale position shown by the two-dot chain line in FIG. 5 or from the aforesaid reduced scale position to the aforesaid equal scale position according to the desired ratio of copying selected, more specifically according to whether the copying is carried out in a substantially equal scale mode or in a reduced scale mode at a predetermined ratio. As stated hereinabove, this movement of the supporting frames 102 and 156 is achieved by the operation of the drive source, i.e. the reversible electric motor 176 (FIG. 5), of the moving mechanism 172. The operation of the reversible electric motor 176 is controlled by the control circuit shown in FIG. 15.

(1) Movement from the Equal Scale Position to the Reduced Scale Position

Figure 15:
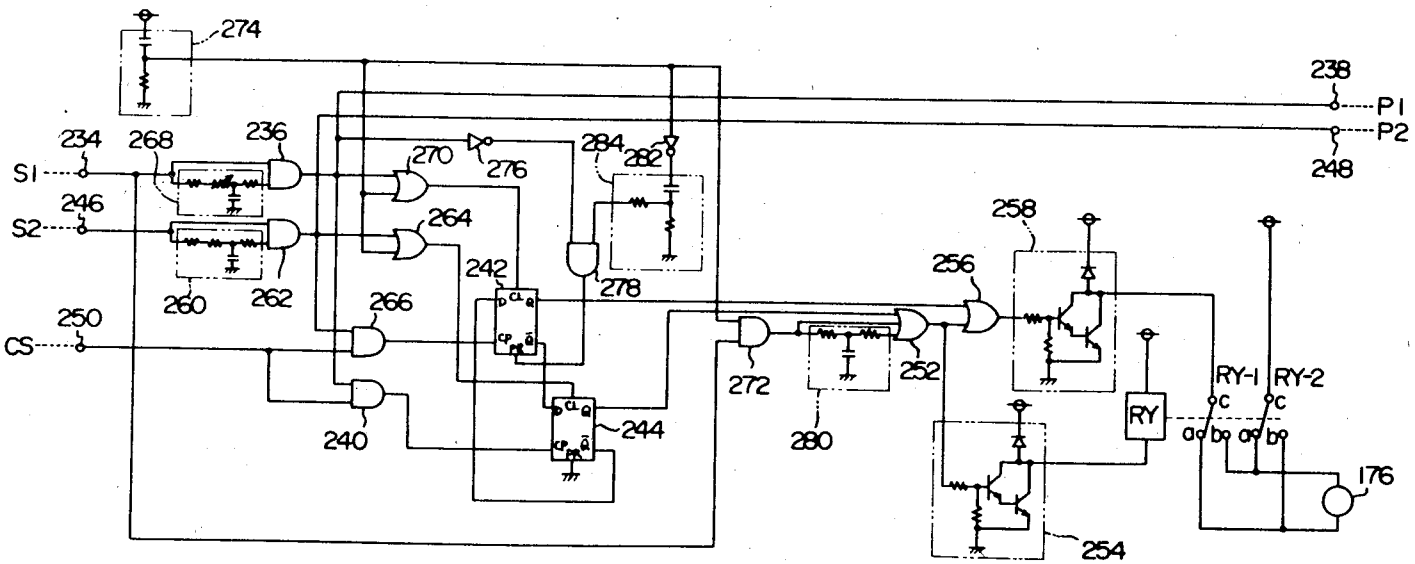
FIG. 15 is a circuit diagram showing a control circuit for the optical device used in the copying apparatus shown in FIG. 1.

With reference to FIGS. 15 and 5, when the supporting frames 102 and 156 are at the equal scale positions, the detecting switch S1 detects the permanent magnet 120 secured to the supporting frame 102 and produces a signal indicating the equal scale positions. In this case, a signal "H" is put into an input terminal 234. The signal "H" is fed to an AND gate 236, and consequently, the AND gate 236 produces a signal "H" and feeds it to an output terminal 238. When the signal "H" has been fed to the output terminal 238, a lamp P1 displaying the equal scale position which is provided, for example, in an operating panel (not shown) of the copying machine is turned on. The signal "H" produced by the AND gate 236 is also fed into one input terminal of an AND gate 240. Flip-flops 242 and 244 are reset when the power supply is set in operation. On the other hand, the detecting switch S2 does not detect the permanent magnet 120 secured to the supporting frame 102, and therefore, a signal "L" is put into an input terminal 246. When the signal "L" is being fed to the input terminal 246, a signal from an output terminal 248 is also "L", and a lamp P2 displaying the reduced scale position provided, for example, in the operating panel (not shown) of the copying apparatus is turned off.

When reduced scale copying is desired in the aforesaid state, the operator depresses a change-over switch CS provided, for example, in the operating panel (not shown) of the copying apparatus. As a result, a signal "H" is put into an input terminal 250, and fed into the other input terminal of the AND gate 240 whereby the AND gate 240 produces a signal "H". The signal "H" produced by the AND gate 240 is fed into an input terminal CP of the flip-flop 244. Since a signal "H" is being fed to a data input terminal D of the flip-flop 244 from an output terminal $\overline{Q}$ of the reset flip-flop 242, the flip-flop 244 produces a signal "H" at an output terminal Q in response to the feeding of the signal "H" to the input terminal CP of the flip-flop 244. The signal "H" produced at the output terminal Q of the flip-flop 244 is fed to an OR gate 252, whereby the OR gate 252 produces a signal "H". The signal "H" outputted from the OR gate 252 is fed to a driver 254 to render it electrically conducting. When the driver 254 is rendered conducting, a current flows from the power supply to a relay RY to energize the relay RY. As a result, contacts RY-1 and RY-2 of the relay RY which have been conducting to a terminal a are rendered conducting to a terminal b. In the meantime, the signal "H" outputted from the OR gate 252 is also fed to a driver 258 through an OR gate 256 to render the driver 258 electrically conducting. When the driver 258 is thus rendered conducting, a current flows from the power supply through a terminal c of the contact RY-2, the terminal b of the contact RY-2, the reversible electric motor 176, the terminal b of the contact RY-1, a terminal c of the contact RY-1, and the driver 258. Thus, the motor 176 is normally rotated.

When the motor 176 is normally rotated, the supporting frames 102 and 156 begin to be moved in the direction of arrow 230 from the equal scale positions to the reduced scale positions. As a result, the detecting switch S1 fails to detect the permanent magnet 120 and the signal fed into the input terminal 234 becomes "L". When the signal "L" is fed to the input terminal 234, the output signal of the AND gate 236 also becomes "L". Hence, the signal at the output terminal 238 also becomes "L" and the lamp P1 displaying the equal scale position is turned off.

When the motor 176 continues to rotate normally and the supporting frames 102 and 156 reach the reduced scale positions or their vicinity (in which case the supporting frame 102 approaches or abuts against the stop piece 112*a*), the detecting switch S2 detects the permanent magnet 120 to produce a signal indicating the reducing position. The signal "H" is then fed into an AND gate 262 after a predetermined delay time by a delay circuit 260. Upon the feeding of the signal "H" into the AND gate 262, the AND gate 262 outputs the signal "H" and feeds it to a clearing input terminal CL of the flip-flop 244 through an OR gate 264. As a result, the signal at the output terminal Q of the flip-flop 244 becomes "L", and the signal fed to the OR gate 252 becomes "L". Since at this time the signal fed to the remaining input terminals of the OR gate 252 is "L", the output signal of the OR gate 252 is "L". The output signal "L" of the OR gate 252 is fed to the OR gate 256. Since at this time a signal "L" is fed to another input terminal of the OR gate 256 from the output terminal Q of the flip-flop 242, the output signal of the OR gate 256 is "L". When the output signal of the OR gate 256 becomes "L", the driver 258 becomes non-conducting. At the same time, the supply of a current from the power supply to the motor 176 is stopped to set the motor 176 out of operation. As stated hereinabove, when the motor 176 is stopped, the supporting frames 102 and 156 are accurately held at the reduced scale positions.

The aforesaid output signal "L" of the OR gate 252 is also fed to the driver 254 to render it nonconducting. As a result, the supply of a current from the power supply to the relay RY is stopped to deenergaze the relay RY, and the contacts RY-1 and RY-2 of the relay RY become conducting to the terminal a. The output signal "H" of the AND gate 262 is also fed to the output terminal 248 to turn on the lamp P2 displaying the reduced scale position.

(2) Movement from the Reduced Scale Position to the Equal Scale Position

When it is desired to return the supporting frames 102 and 156 moved to the reduced scale positions as described above to the equal scale positions for copying in a substantially equal scale mode, the operator depresses the change-over switch CS in the same way as described in section (1) above. As a result, a signal "H" is fed to an input terminal 250, and is fed to one input terminal of an AND gate 266. Since at this time a signal indicating the reduced scale position is produced at the other input terminal of the AND gate 266 as a result of the detection of the permanent magnet 120 by the detecting switch S2, the signal "H" is fed to the other input terminal of the AND gate 266 from the AND gate 262. Hence, when the signal "H" is fed to the above one input terminal of the AND gate 266 from the input terminal 250, the AND gate 266 produces a signal "H" and feeds it to a clock pulse input terminal CP of the flip-flop 242. Since at this time, a signal "H" is fed to the data input terminal D of the flip-flop 242 from the output terminal $\overline{Q}$ of the flip-flop 244, a signal "H" is produced at the output terminal Q of the flip-flop 242. This signal "H" is fed to the driver 258 through the OR gate 256 to render the driver 258 conducting. When the driver 258 is rendered conducting, a current flows from the power supply through the terminal c of the contact RY-2, the terminal a of the contact RY-2, the motor 176, the terminal a of the contact RY-1, the terminal c of the contact RY-1, and the driver 258 thereby to rotate the motor reversely.

When the motor 176 is rotated reversely, the supporting frames 102 and 156 begin to be moved in the direction shown by arrow 232 from the reduced scale positions toward the equal scale positions. As a result, the detecting switch S2 fails to detect the permanent magnet 120, and the signal indicating the reduced scale position disappears. Thus, the signal put into the input terminal 246 becomes "L". When the signal put into the input terminal 246 becomes "L", the output signal of the AND gate 262 also becomes "L". Hence, the signal at the output terminal 248 is "L", and the lamp 02 displaying the reduced scale position is turned off.

When the motor 176 continues to be rotated reversely and the supporting frames 102 and 156 reach the equal scale positions or their vicinity (in which case the supporting frame 102 approaches, or abuts against, the stop piece 112*b*), the detecting switch S1 detects the permanent magnet 120 to produce a signal indicating the equal scale position. As a result, a signal "H" is produced at the input terminal 234. This signal "H" is fed to the AND gate 236 after the lapse of a predetermined delay time by a delay circuit 268. When the signal "H" is fed to the AND gate 236, the AND gate 236 outputs the signal "H" and feeds it to the clearing input terminal CL of the flip-flop 242 through an OR gate 270. As a result, the signal at the output terminal Q of the flip-flop 242 becomes "L", and the signal fed to the OR gate 256 becomes "L". Since at this time, the signal at the output terminal Q of the flip-flop 244 is "L" and the output signal of an AND gate 272 is "L", the signal "L" is fed to the other input terminal of the OR gate 256. Accordingly, the output signal of the OR gate 256 becomes "L" to render the driver 258 non-conducting. As a result, the supply of a current from the power supply to the motor 176 is stopped to set the motor 176 out of operation. When the motor 176 has been stopped, the supporting frames 102 and 156 are accurately held at the equal scale positions in the manner already described hereinabove.

In the meantime, the output signal "H" of the AND gate 236 is also fed into the output terminal 238, and the lamp P1 displaying the equal scale position is turned on.

The control circuit illustrated in FIG. 15 controls the motor 176 such that when the operator manually operates the change-over switch CS, the supporting frames 102 and 156 can be correspondingly moved from the equal scale positions to the reduced scale positions or vice versa. In addition to this, in view of the facts mentioned in (a) and (b) below, the control circuit shown in FIG. 15 also controls the motor 176 in such a manner that when the power supply in the copying apparatus is set in operation, the supporting frames 102 and 156 will be automatically held accurately at the equal scale positions not only when the detecting switch S1 is not in condition for detecting the permanent magnet 120 and for producing a signal indicating the equal scale position but also when it is in condition for detecting the permanent magnet 120 and producing the aforesaid signal.

(a) Since in many cases it is desired to perform copying in a substantially equal scale mode, it is convenient to move the supporting frames 102 and 156 to the equal scale positions automatically without requiring a special manual operation (manual operation of the change-over switch) when the power supply is set in operation.

(b) When the motor 176 is stopped as described above, the supporting frames 102 and 156 are accurately held at the equal scale positions or the reduced scale positions. If, for example, the power supply is cut off during the reverse (or normal) rotation of the motor 176, a situation may occur in which the supporting frames 102 and 156 are not sufficiently accurately held at the equal scale positions even when the detecting switch S1 is in condition for detecting the permanent magnet 120 and producing a signal indicating the equal scale position (the supporting frame 102 is not elastically pressed against the stop piece 112*b* by the action of the tension spring 200). It is desired therefore to automatically perform an operation of accurately holding the supporting frames 102 and 156 at the equal scale positions during the operation of the power supply even if the detecting switch S1 is in condition for detecting the permanent magnet 120 and producing a signal indicating the equal scale position.

(3) Movement During the Operation of the Power Supply (3-1) Firstly, let us assume that during the operation of the power supply, the supporting frames 102 and 156 are located at the equal scale positions or their vicinity and therefore the detecting switch S1 is in condition for detecting the permanent magnet 120. When a power supply switch (not shown) provided, for example, in the operating panel (not shown) of the copying apparatus is closed, a power supply operation detecting devic- 274, which can be constructed, for example, of a pulse generating circuit, produces a signal "H" over a predetermined period of time. The signal "H" is fed to one input terminal of the AND gate 272. On the other hand, because the detecting switch S1 detects the permanent magnet 120 and produces a signal indicating the equal scale position, the signal "H" is put into the input terminal 234, and this signal "H" is fed to the other input terminal of the AND gate 272. Hence, the AND gate 272 outputs the signal "H" and feeds it to the OR gate 252. As a result, the motor 176 is normally rotated as described in section (1) above, and the supporting frames 102 and 156 begin to be moved in the direction of arrow 230 toward the reduced scale positions.

When the supporting frames 102 and 156 are moved in the direction of arrow 230, the detecting switch S1 no longer detects the permanent magnet 120, and the signal indicating the equal scale position disappears. Thus, the input signal at the input terminal 234 becomes "L". As a result, the output signal of the AND gate 236 becomes "L", and the signal "L" is reversed to "H" by an inverter 276 and then fed to one input terminal of an AND gate 278. Thereafter, the signal from the power supply operation detector 274 becomes "L". This signal "L" is fed to an inverter 282, and after being reversed to "H" by the inverter 282, it is fed to a pulse generator circuit 284. Thus, the pulse generator circuit 284 produces a signal "H". The signal "H" is fed to the other input terminal of the AND gate 278. Since at this time the signal "H" from the inverter 276 is fed to the one input terminal of the AND gate 278, the output signal of the AND gate 278 becomes "H". The output signal "H" of the AND gate 278 is fed to a preset input terminal PR of the flip-flop 242, whereby the flip-flop 242 produces a signal "H" at its output terminal Q. The signal "H" is fed to the OR gate 256, and the output signal of the OR gate 256 continues to be "H". In the meantime, the signal "L" from the input terminal 234 is also fed to the AND gate 272, and the output signal of the AND gate 272 becomes "L". The output signal "L" of the AND gate 272 is fed to the OR gate 252 after the lapse of a predetermined delay time by a delay circuit 280. Since at this time the signal "L" is also fed to the OR gate 252 from the output terminal Q of the flip-flop 244, the output signal of the OR gate 252 becomes "L". As a result, the driver 254 is rendered non-conducting and the relay RY is deenergized. Upon the deenergization of the relay RY, the contacts RY-1 and RY-2 which are conducting to the terminal b become conducting to the terminal a. As a result, the motor 176 is reversely rotated, and the moving directions of the supporting frames 102 and 156 are reversed, and they are moved in the direction of arrow 232 toward the equal scale positions. Thereafter, the supporting frames 102 and 156 are accurately held at the equal scale positions and then the motor 176 is stopped, as described in section (2) above.

(3-2) Now, let us assume that during the operation of the power supply, the supporting frames 102 and 156 are located at the reduced scale positions or their vicinity (in which case the detecting switch S2 is in condition for detecting the permanent magnet 120), or they are located between the equal scale position and the reduced scale position in which case the detecting switch S1 is not in condition for detecting the permanent magnet 120. In this case, too, when the power supply switch (not shown) is closed, the power supply operation detector 274 produces a signal "H" over a predetermined period of time. When the signal of the power supply operation detector 274 becomes "L" after the lapse of the predetermined period of time, the signal "L" is reversed to "H" by the inverter 282 and then fed to the pulse generator circuit 284. As a result, the pulse generator circuit 284 produces a signal "H", and feeds it to one input terminal of the AND gate 278. On the other hand, the input signal of the input terminal 234 is "L" because the detecting switch S1 does not detect the permanent magnet 120 and therefore does not produce a signal indicating the equal scale position. This signal "L" is reversed to "H" by the inverter 276 and fed to the other input terminal of the AND gate 278. Accordingly, when the signal "H" is fed to one input terminal of the AND gate 278 from the pulse generator circuit 284, the AND gate 278 produces a signal "H" and feeds it to the present input terminal PR of the flip-flop 242. As a result, the flip-flop 242 produces a signal "H" at its output terminal Q, and feeds it to the OR gate 256. Thus, the output signal of the OR gate 256 becomes "H", and the driver 258 becomes conducting. At the same time, the motor 176 is reversely rotated as described in section (2) above, and the supporting frames 102 and 156 begin to be moved in the direction of arrow 232 toward the equal scale positions. As described in (2) above, the motor 176 is stopped after the supporting frames 102 and 156 are held accurately at the equal scale positions.

Drive System

The drive system of the illustrated copying apparatus will be described briefly below mainly with reference to FIG. 16.

Figure 16:
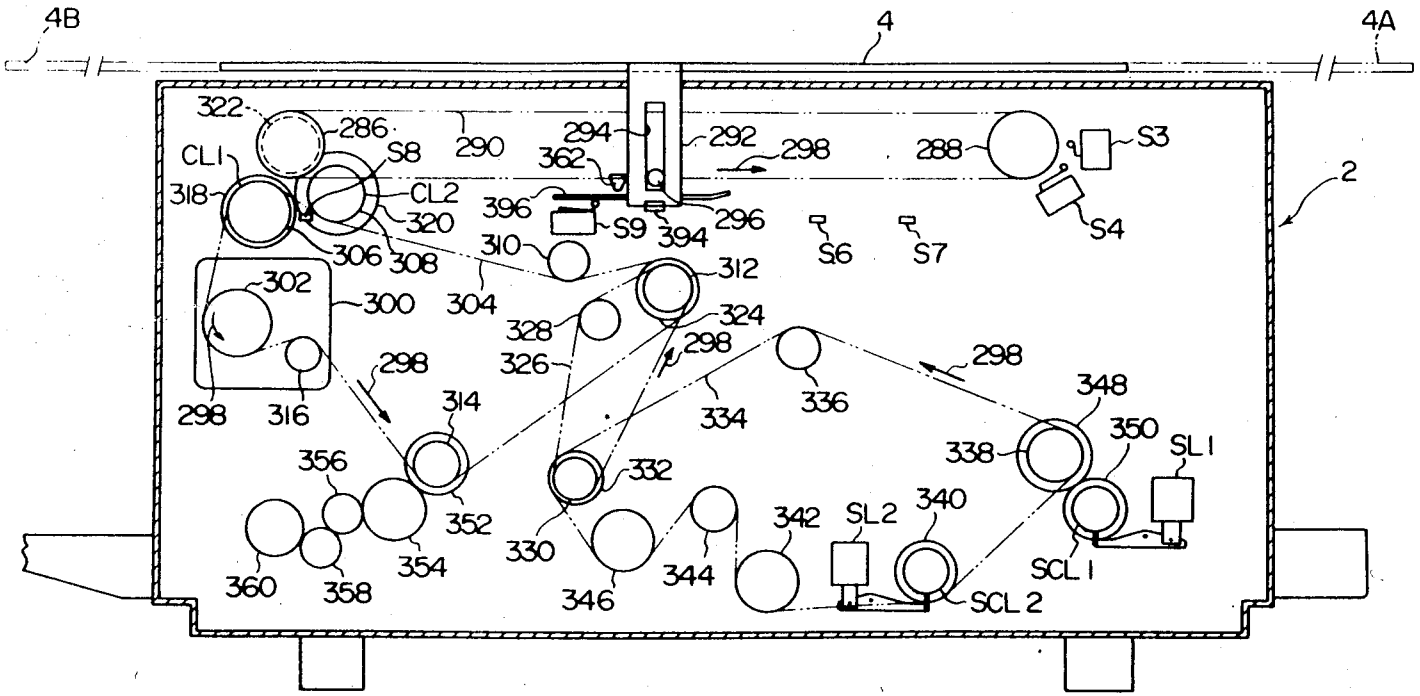
FIG. 16 is a simplified view showing a drive system used in the copying apparatus shown in FIG. 1.

A pair of a wheel 286 and a wheel 288, conveniently sprocket wheels, are rotatably mounted at spaced-apart relationship in the left and right directions in FIG. 16 at the upper end portion of the housing 2. An endless wrapping power transmission member 290, conveniently a chain, is wrapped about the wheels 286 and 288. A suspending piece 292 is attached to the transparent plate 4 disposed movably in the right and left directions in FIG. 16 at the upper surface of the housing 2. In the suspending piece 292 is formed an opening 294 which extends in the up-and-down direction over the upper and lower travelling sections of the power transmission member 290. An interlocking pin 296 formed in the wrapping power transmission member 290 is inserted in the opening 294. It will be readily appreciated therefore that when the wrapping power transmission member 290 is driven in the direction shown by an arrow 298 in the manner described hereinafter, the transparent plate 4 is caused to make a preparatory movement in the right direction in FIG. 16 from its stop position shown by a solid line in FIG. 16 (and FIG. 1) to its start-of-scan position shown by the two-dot chain. line 4A in FIG. 16 (and FIG. 1); thereafter, to make a scanning movement in the left direction in FIG. 16 from the start-of-scan position to its end-of-scan position shown by a two-dot chain line 4B in FIG. 16 (and FIG. 1); and thereafter, to make a return movement in the right direction from the end-of-scan position to the stop position shown by the solid line in FIG. 16 (and FIG. 1).

On the other hand, a main drive source 300 composed of an electric motor is disposed near the left end of the housing 2 in FIG. 16, and a sprocket wheel 302 is connected to the output shaft of the main drive source 300. The sprocket wheel 302 is drivingly connected by means of an endless chain 304 to a sprocket wheel 306 having a relatively large diameter, a sprocket wheel 308 having a relatively small diameter, an idle sprocket wheel 310, a sprocket wheel 312, a sprocket wheel 314 and an idle sprocket wheel 316. The sprocket wheel 306 is connected to a gear 318 through an electromagnetic clutch CL1, and the sprocket wheel 308 is connected to a gear 320 through an electromagnetic clutch CL2. The gear 318 is engaged with the gear 320, and the gear 320 is engaged with a gear 322 which rotates as a unit with a wheel 286 about which the wrapping power transmission member 290 is wrapped. The sprocket wheel 312 has affixed thereto a sprocket wheel 324 which rotates as a unit with the sprocket wheel 312. The sprocket wheel 324 is drivingly connected to an idle sprocket wheel 328 and a sprocket wheel 330 by means of an endless chain 326. The sprocket wheel 330 has affixed thereto a sprocket wheel 332 which rotates as a unit with the sprocket wheel 330. The sprocket wheel 332 is drivingly connected by means of an endless chain 334 to an idle sprocket wheel 336, a sprocket wheel 338, a sprocket wheel 340, a sprocket wheel 342, an idle sprocket wheel 344 and a sprocket wheel 346. The sprocket wheel 330 is drivingly connected to a rotating drum 8 and the operating part of a developing device 18 (FIG. 1) by a suitable drivingly connecting mechanism (not shown) such as a gear train. The sprocket wheel 338 has affixed thereto a gear 348 which rotates as a unit with the sprocket wheel 338. The gear 348 is engaged with a gear 350. The gear 350 is connected to a feed roller 38 (FIG. 1) through a clutch SCL1 controlled by a solenoid SL1. The sprocket wheel 340 is connected to lower rollers of the delivery roller unit 42 (FIG. 1) through a clutch SCL2 controlled by a solenoid SL2. The sprocket wheel 342 is connected to lower rollers of the conveying roller unit 46 (FIG. 1), and the sprocket wheel 346 is connected to the roller 50 (FIG. 1). The sprocket 314 has affixed thereto a gear 352 which is driven as a unit with the sprocket 314. The gear 352 is connected successively to gears 354, 356, 358 and 360. The gear 354 is connected to the upper rollers of the fixing roller unit 54 (FIG. 1), and the gear 358, to the upper rollers of the conveying roller unit 58 (FIG. 1).

With reference to FIG. 16 together with FIG. 1, in the drive system described above, the main drive source 300 is energized to rotate the sprocket wheel 302 in the direction shown by an arrow 298, and the endless chains 304, 326 and 334 are driven in the direction of the arrow 298. Thus, the rotating drum 8 is rotated in the direction of arrow 12, and the conveying roller unit 46, the roller 50, the fixing roller unit 54 and the conveying roller unit 58 of the paper conveying mechanism 32 are rotated in the required directions. When the clutch CL1 comes into operation, the wrapping power transmission member 290 is driven in the direction of arrow 298 at a predetermined speed $V_1$ (which is substantially the same as the moving speed of the photosensitive member 10 disposed on the peripheral surface of the rotating drum 8) to move the transparent plate as required. When the clutch CL2 is operated in place of the clutch CL1, the wrapping power transmission member 290 is moved in the direction of arrow 298 at a speed $V_2$ obtained by multiplying the aforesaid predetermined speed by the reciprocal of the copying ratio M ($V_2=V_1/M$) to move the transparent plate 4 as required. When the solenoid SL1 is energized, the feed roller 38 of the paper feed mechanism 30 is rotated in the direction of arrow 40. When the solenoid SL2 is energized, the delivery roller unit 42 of the paper conveying mechanism 32 is rotated in the required direction.

Control of Paper Conveying

In a copying apparatus of the type adapted to form a latent electrostatic image or a toner image on the photosensitive member 10 disposed on the peripheral surface of the rotating drum 8 by an image-forming step including the slit exposure scanning of an original document to be copied, and then transferring the latent electrostatic image or the toner image on the photoseneitive member 10 to a copying paper in the transfer zone 26, as in the copying apparatus shown in the drawings, it is important that the leading edge of the latent electrostatic image or the toner image on the photosensitive member 10 and the leading edge of the copying paper should arrive synchronously at the transfer zone 26 as prescribed. In order to achieve it, it is necessary to control the conveying of the copying paper in a required relation to slit exposure scanning carried out by the movement of the transparent plate 4 on which to place a document to be copied or at least a part of the optical device 66 (in the illustrated copying apparatus, by the movement of the transparent plate 4). On the other hand, in a copying apparatus capable of performing copying in at least two ratios, specifically at a ratio of substantially 1 and on a reduced scale at a predetermined ratio (e.g., about 0.7 in length and about 0.5 in area ) as in the illustrated copying apparatus, the speed of slit exposure scanning is varied according to a selectively prescribed copying ratio as stated hereinabove. In the illustrated copying apparatus, in the case of substantially equal scale copying, slit exposure scanning is carried out by moving the transparent plate 4 at a predetermined speed $V_1$ (which is substantially the same as the moving speed of the photosensitive member 10 disposed on the peripheral surface of the rotating drum 8). In the case of reduced scale copying at the predetermined ratio M, the transparent plate 4 is moved at a speed $V_2(=V_1/M)$ to perform slit exposure scanning.

In the copying apparatus of this invention, synchronizing switches in number correspohding to the number of copying ratios to be selected are provided. When a specified ratio of copying is selected, a synchronizing switch corresponding to it functions and controls the conveying of a copying paper in the required relationship to the slit exposure scanning. Accordingly, whichever ratio of copying is chosen, the leading edge of the latent electrostatic image or the toner image formed on the photosensitive member 10 and the leading edge of the copying paper arrive substantially synchronously at the transfer zone 26.

Figure 17:
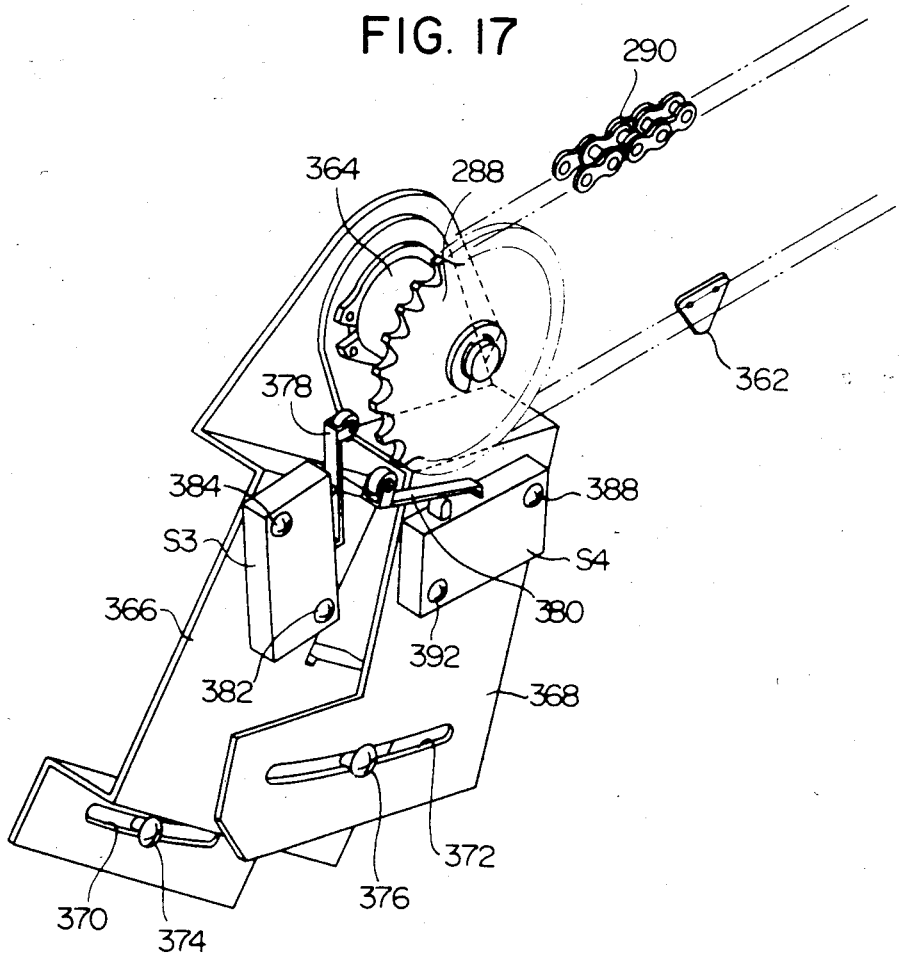
FIGS. 17 and 18 are a partial perspective view and a partial sectional view showing the modes of mounting synchronizing switches used in the copying apparatus shown in FIG. 1.
Figure 18:
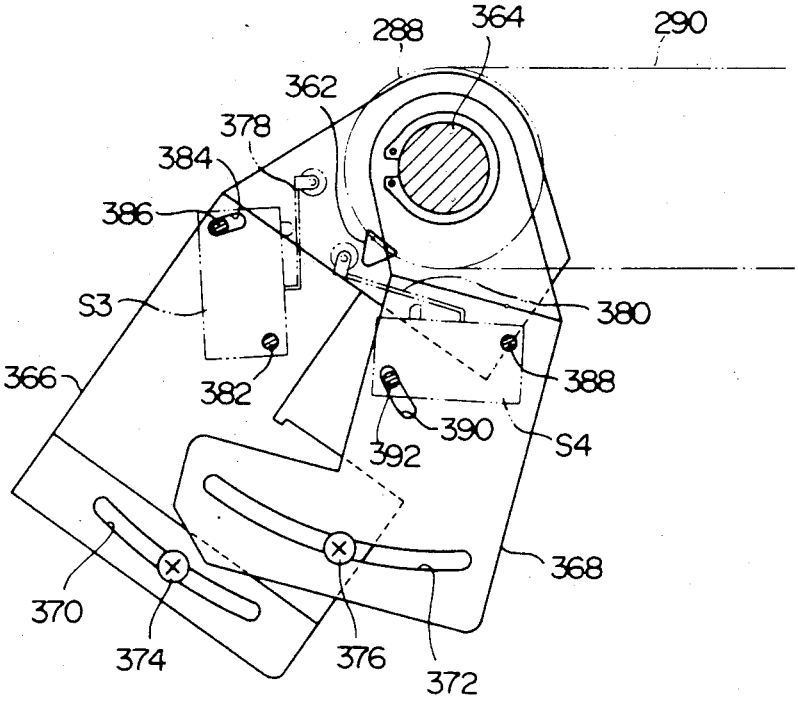

With reference to FIGS. 17 and 18 together with FIG. 16, an actuator 362 made of a suitalbe projecting piece is fixed to the wrapping power transmission member 290 to which the transparent plate 4 is drivingly connected. In relation to the actuator 362, a synchronizing switch S3 functioning in the case of substantially equal scale copying (i.e., when the clutch CL1 is actuated and the wrapping power transmission member 290 is moved at the speed $V_1$) and a synchronizing switch S4 functioning in the case of reduced scale copying at the predetermined ratio M (i.e., when the clutch CL2 is actuated and the wrapping power transmission member 290 is moved at the speed $V_2=V_1/M$) are provided. The manner of mounting the synchronizing switches S3 and S4 will be described with reference to FIGS. 17 and 18. Mounting plates 366 and 368 are pivotally mounted on a supporting shaft 364 on which the wheel 288 having the wrapping power transmission member 290 wrapped thereabout is mounted rotatably. The mounting plates 366 and 368 respectively have arcuate slits 370 and 372 having the supporting shaft 364 as a center. By screwing a setscrew 374 into a suitable stationary member (not shown) through the slit 370, the mounting plate 366 is fixed so that its pivoting angular position can be adjusted freely. On the other hand, by screwing a setscrew 376 into the mounting plate 366 though the slit 372, the mounting plate 368 is fixed so that its pivoting angular position can be adjusted freely. The synchronizing switch S3 is comprised of a microswitch having a detecting arm 378 and is mounted on the mounting plate 366 so that its position can be adjusted freely. On the mounting plate 368 is mounted the synchronizing switch S4 comprised of a microswitch having a detecting arm 380 so that its position can be freely adjusted. In more detail, as shown in FIG. 18, by linking the synchronizing switch S3 pivotally to the mounting plate 366 by a linking pin 382 and also by a bolt 386 extending through an arcuate slit 384 formed in the mounting plate 366 and having the linking pin 382 as a center, the synchronizing switch S3 is mounted on the mounting plate 366 so that its pivoting angular position about the linking pin 382 as a center can be freely adjusted, and therefore, its position can be freely adjusted in a direction in which the end of the detecting arm 378 moves toward and away from the wrapping power transmission member 290. Likewise, by linking the synchronizing switch S4 to the mounting plate 368 by means of a linking pin 388 pivotably and also by means of a bolt 392 extending through an arcuate slit 390 formed in the mounting plate 368 and having the linking pin 388 as a center, the synchronizing switch S4 is mounted on the mounting plate 368 so that its pivoting angular position about the linking pin 388 as a center can be freely adjusted and therefore, its position can be freely adjusted in a direction in which the end of the detecting arm 380 moves toward and away from the wrapping power transmission member 290. It will be appreciated therefore that the positions of the actuator 362 fixed to the wrapping power transmission member 290 at which it acts on the detecting arm 378 of the synchronizing switch S3 and the detecting arm 380 of the synchronizing switch S4 can be finely adjusted by adjusting the pivoting angular positions of the mounting plates 366 and 368 and the pivoting angular positions of the synchronizing switches S3 and S4 with respect to the mounting plates 366 and 368.

Figure 19:
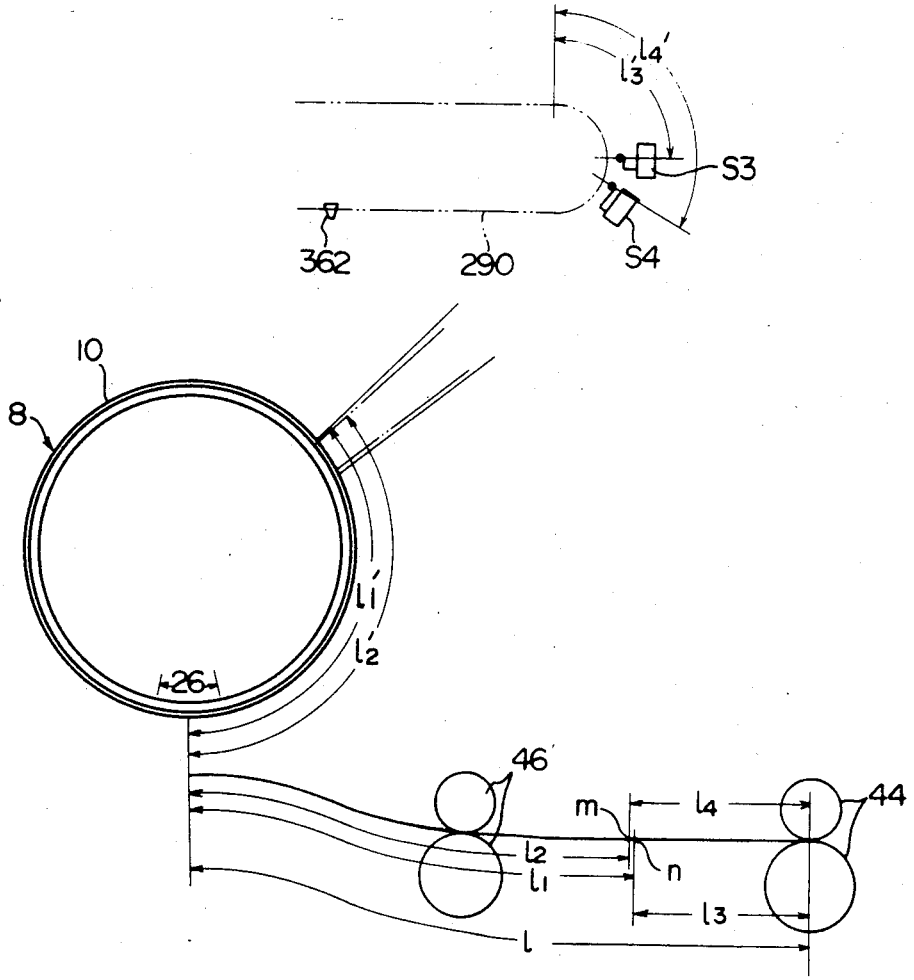
FIG. 19 is a diagrammatic view for illustrating a method of controlling transfer of a copying paper.

The action of the synchronizing switches S3 and S4 to control conveying of a copying paper will now be described with reference to FIG. 19 taken in conjunction with FIGS. 1 and 16. As will be described in detail hereinbelow, in the illustrated copying apparatus, by depressing a switch S5 (FIG. 20) for starting of copying, the clutch CL1 or CL2 is actuated to start the movement of the transparent plate 4. Furthermore, the solenoid SL1 is energized to start rotation of the feed roller 38. As a result, a copying paper is fed from the paper feed mechanism 30 to the delivery roller unit 42 of the paper conveying mechanism 32. At this time, however, the delivery roller unit 42 of the paper conveying mechanism 32 is still out of operation, and the copying paper fed from the paper feed mechanism 30 is caused to wait while its leading edge abuts against the nip position of the delivery roller unit 42.

When copying is carried out on a substantially equal scale and therefore the clutch CL1 is actuated to drive the wrapping power transmission member 290 at the above speed $V_1$, the movement of the transmission member 290 causes the actuator 362 to operate the synchronizing switch S3, and accordingly energize the solenoid SL2. Thus, the delivery roller unit 42 begins to rotate and a copying paper begins to be conveyed toward the transfer zone 26. On the other hand, when copying is carried out on a reduced scale at the predetermined ratio M and therefore the clutch CL2 is actuated to move the power transmission member 290 at the speed $V_2(=V_1/M)$, the movement of the transmission member 290 causes the actuator 362 to operate the synchronizing switch S4 and accordingly energize the solenoid SL2. Thus, the delivery roller unit 42 begins to rotate and a copying paper begins to be conveyed toward the transfer zone 26.

The positions of the synchronizing switches S3 and S4 are prescribed as follows: The position of the synchronizing switch S3 is prescribed such that the copying paper is advanced from the nip position of the delivery roller unit 42 to the position n before the slit exposure scanning of an original document is started after actuation of the synchronizing switch S3 (in the illustrated copying apparatus, the slit exposure scanning of the document when th.e transparent plate 4 has moved a certain distance to the left in FIG. 1 from the start-of-scan position shown by the two-dot chain line 4A in FIG. 1). The position of the synchronizing switch S4 is prescribed such that the copying paper is advanced from the nip position of the conveying roller unit 42 to the position m before the slit exposure scanning of the document is started after actuation of the synchronizing switch S4. The conveying length $l_1$ of the copying paper from the position n to the center of the transfer zone 26 is substantially the same as the moving length $l'_1$ of the photosensitive member 10 from the upstream end of the image of the document projected on substantially the same scale onto the photosensitive member 10 to the center of the transfer zone 26. On the other hand, the conveying length $l_2$ of the copying paper from the position m to the center of the transfer zone 26 is substantially the same as the moving length $l'_2$ of the photosensitive member 10 from the upstream end of the image of the document projected on a reduced scale at the predetermined ratio M onto the photosensitive member 10 to the center of the transfer zone 26.

In other words, the positions of the synchronizing switches S3 and S4 are prescribed so as to satisfy the following expressions.

$$l_3=l'_3$$

$$l_4=V_1/V_2 \cdot l'_4=l'_4 \cdot M$$

wherein $l_3$ is the conveying distance of the copying paper from the nip position of the conveying roller unit 42 to the position n, $l_4$ is the conveying length of the copying paper from the nip position of the conveying roller unit 42 to the position m, $l'_3$ is the moving distance of the actuator 362 from the actuation of the synchronizing switch S3 by the actuator 362 fixed to the wrapping power transmission member 290 to the start of the slit exposure scanning, and $l'_4$ is the moving distance of the actuator 362 from the actuation of the synchronizing switch S4 by the actuator 362 to the start of the slit exposure scanning.

It will be appreciated therefore that whether copying is carried out in a substantially equal scale mode or a reduced scale mode at the predetermined ratio M, conveying of a copying paper from the nipping position of the conveying roller unit 42 is started in the required relationship to the slit exposure scanning, and the leading edge of a latent electrostatic image or a toner image formed on the photosensitive member 10 and the leading edge of the copying paper arrive at the transfer zone 26 substantially in synchronism.

In the above description, it is assumed that the conveying length l of the copying paper from the nipping position of the conveying roller unit 42 to the center of the transfer zone 26 is larger than the length $l'_1$ or $l'_2$. It will be readily seen that even when the length l is less than the length $l'_1$ or $l'_2$, the starting of the copying conveying of a copying paper (the starting of the rotation of the conveying roller unit 42) can be controlled by the synchronizing switches S3 and S4 in the same manner as described above (in which case the actuator 362 actuates the synchronizing switch S3 or S4 after the starting of the slit exposure scanning).

In the embodiment described above, the synchronizing switches S3 and S4 control the starting of the copying paper by detecting the movement of the transparent plate 4, more specifically the movement of the wrapping power transmission member 290 to which the transparent plate 4 is drivingly connected. If desired, the synchronizing switch S3 or S4 may be constructed of a timer which is actuated after the lapse of a certain period of time from the starting of the movement of the transparent plate 4 from its stop position. However, if the synchronizing switch S3 or S4 is made up of a timer, it is comparatively difficult to adjust the time of actuation of the synchronizing switch S3 or S4 as required.

Operating Sequence

The illustrated copying apparatus also has provided therein the following operation controlling elements in addition to the switches, solenoids and clutches already described above. As shown in FIG. 16, switches S6, S7, S8 and S9 are disposed along the moving path of the suspending piece 292 attached to the transparent plate 4. The switches S6, S7 and S8 are comprised of proximity switches, and detect a permanent magnet 394 fixed to the suspending piece 292 when the transparent plate 4 moves. The switch S9 is a microswitch and detects the actuator 396 fixed to the suspending piece 292 when the transparent plate 4 moves from left to right in FIG. 16, and returns to its stop position shown by the solid line in FIG. 16. Furthermore, as shown in FIG. 1, switches S10, S11, S12 and S13 are provided in the paper feeding and conveying passages. These switches S10, S11, S12 and S13 composed of microswitches detect the copying paper. Furthermore, a solenoid SL3 is attached to the cleaning device 22 as shown in FIG. 1. When energized, the solenoid SL3 moves the cleaning device 22 from its nonoparative position shown by the two-dot chain line in FIG. 1 and hold it at its operative position shown by the solid line in FIG. 1.

Figure 20:
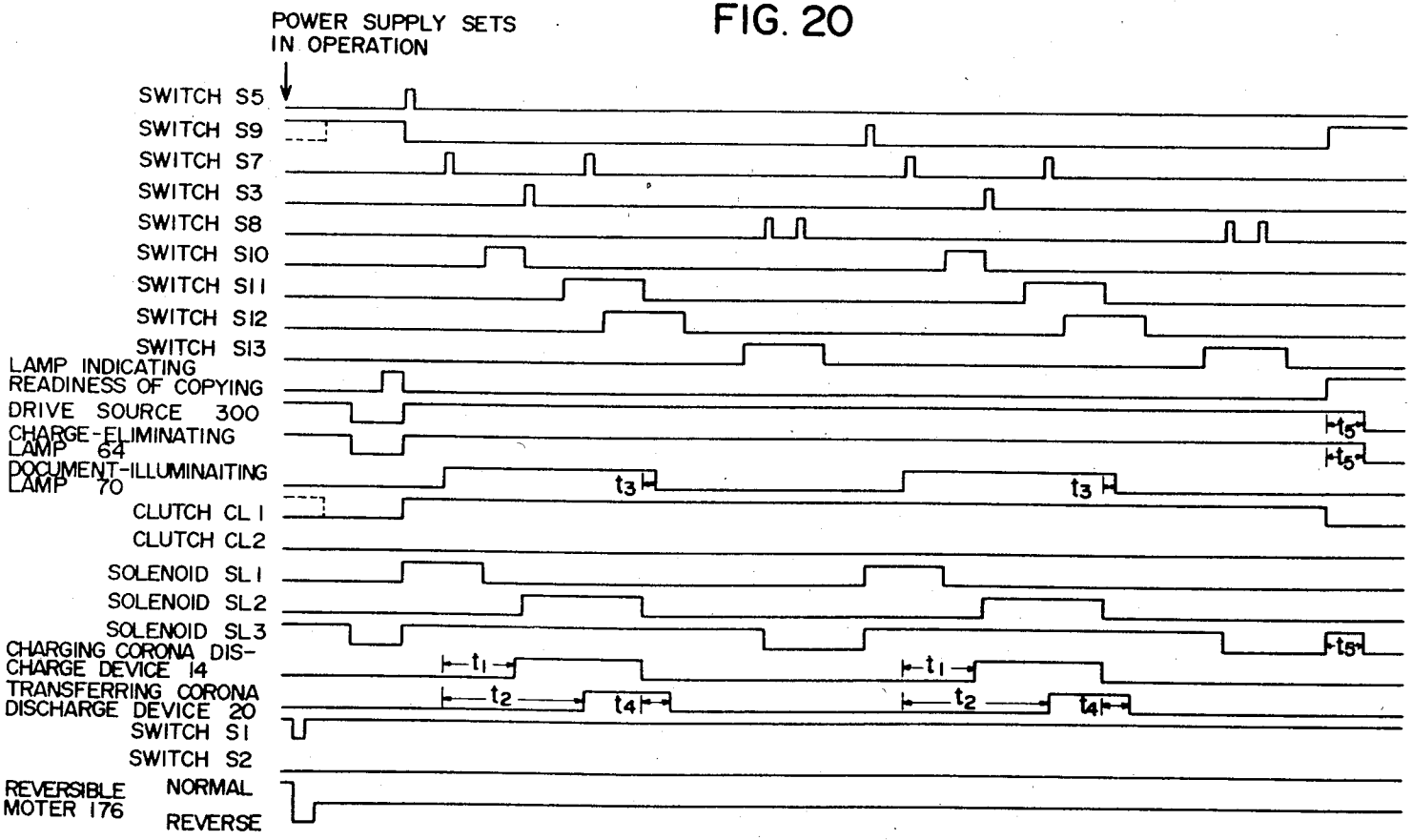
FIG. 20 is a time chart showing the sequence of operations of the copying apparatus shown in FIG. 1.

The sequence of operating the copying apparatus controlled by the above-described controlling elements is briefly described below with reference to the time chart of FIG. 20 taken in conjunction with FIGS. 1 and 16.

(A) Copying at a Ratio of Substantially 1

(A-1) When the power supply sets in operation upon closing of the power supply switch (not shown), the drive source 300, the charge-eliminating lamp 64 and the solenoid SL3 are energized for a predetermined period of time (e.g., 3 seconds) to perform preliminary charge-elimination and cleaning of the photosensitive member 10.

Furthermore, as already described in detail with reference to FIG. 15, the reversible electric motor 176 in the optical device 66 is controlled as prescribed, and the supporting frames 102 and 156 are accurately held at the equal scale positions. Furthermore, as shown by a broken line in FIG. 20, when the transparent plate 4 is not at its top position (the position shown by a solid line in FIGS. 1 and 16) and therefore the switch S9 is open, the clutch CL1 is actuated to return the transparent plate 4 to its stop position.

When the temperature of one set of rollers of the fixing roller units 54 exceeds a predetermined value by the heating action of a heater which begins to be energized at the time of the power supply setting in operation, a lamp indicating that the copying apparatus is ready for starting the copying process (the lamp is disposed, for example, in an operating panel not shown) is turned on.

(A-2) Thereafter, the operator depresses the copying start switch S5 to close it temporarily. As a result, the main drive source 300 is energized and the clutch CL1 is actuated to start movement of the transparent plate 4. The solenoid SL1 is energized to rotate the feed roller 38 and start feeding of a copying paper. The solenoid SL3 is also energized to bring the cleaning device 22 into its operative position, and the charge-eliminating lamp 64 is turned on.

(A-3) The switch S7 is temporarily closed by the movement of the transparent plate 4, and thereby the document-illuminating lamp 70 is turned on.

After the lapse of a certain delay time $t_1$ from the time of closing the switch S7, the charging corona discharging device 14 is energized, and after the lapse of a predetermined delay time $t_2$, the transfer corona discharging device 20 is energized.

(A-4) When the copying paper which began to be fed in (A-2) above bends upwardly upon contact with the nipping position of the delivery roller unit 42 which is out of operation, the switch S10 is closed, thereby deenergizing the solenoid SL1 and stopping the feed roller 38.

(A-5) By the movement of the transparent plate 4 (the wrapping power transmission member 290), the switch S3 is temporarily closed. As a result, the solenoid SL2 is energized and the delivery roller unit 42 is rotated to start conveying of the copying paper.

(A-6) Upon the arrival of the leading edge of the copying paper at the switch S11, the switch S11 is closed (the closing of the switch S11 is related to a timer not shown and utilized for detecting paper jamming).

(A-7) Upon the arrival of the leading edge of the copying paper at the switch S12, the switch S12 is closed (the closing of the switch S12 is also utilized for paper jamming).

(A-8) When the trailing edge of the copying paper has gone past the switch S11, the switch S11 is opened (the opening of the switch S11 is also utilized for detecting paper jamming). As a result, the solenoid SL2 is deenergized and the delivery roller unit 42 is stopped. Also, the charging corona discharging device 14 is deenergized.

After the lapse of a predetermined delay time $t_3$ from the opening of the switch S11, the document-illuminating lamp 70 is turned off, and after the lapse of a predetermined delay time $t_4$, the transfer corona discharging device 20 is deenergized.

(A-9) When the trailing edge of the copying paper has gone past the switch S12, the switch S12 is opened (the opening of the switch S12 is also utilized for detecting paper jamming).

(A-10) When the leading edge of the copying paper arrives at the switch S13, the switch S13 is closed (the closing of the switch S13 is also utilized for detecting paper jamming).

(A-11) By the movement of the transparent plate 4, the switch S8 is temporarily closed, whereby the solenoid SL3 is deenergized and the cleaning device 22 is returned to its nonoperative position.

(A-12) When the trailing edge of the copying paper has gone past the switch S13, the switch S13 is opened (the opening of the switch S13 is also utilized for detecting paper jamming).

(A-13) Upon the returning of the transparent plate 4 to its stop position, the switch S9 is closed.

Thus, when a number of 2 or more is preset at a multiple copy presetting device (not shown) for obtaining a multiplicity of copies (in FIG. 20, a number of 2 is preset), the solenoid SL1 is energized and the feed roller 38 is rotated. At the same time, the feeding of a copying paper is started and the solenoid SL3 is energized to bring the cleaning device 22 into its operating position. Thus, the next cycle of copying is started.

On the other hand, when the copying process is repeatedly carried out a number of times corresponding to the preset number, the returning of the transparent plate 4 to its stop position causes deenergization of the clutch CL1 thereby stopping the transparent plate 4. When this causes the closing of the switch S9, the lamp showing readiness of starting of copying is turned on and the solenoid SL3 is energized to bring the cleaning device 22 into its operating position.

After the lapse of a certain dealy time $t_5$ from the closing of the switch S9, the main drive source 300 is deenergized, the charge-eliminating lamp 64 is turned off, and the solenoid SL3 is deenergized to bring the cleaning device 22 back into its non-operative position.

(B) Reduced Scale Copying at a Predetermined Ratio

When it is desired to perform copying on a reduced scale at a predetermined ratio, the change-over switch CS (FIG. 15) is manually operated to hold the supporting frames 102 and 156 of the optical device 66 at their reduced scale positions. Then, the copy start switch S5 is depressed to close it temporarily and thus to start the copying process. In this case, the clutch CL2 acts in place of the clutch CL1, the switch S4 (FIG. 16) acts in place of the switch S3, and the switch S6 (FIG. 16) acts in place of the switch S7. The charge-eliminating lamp 16 (FIG. 1) is turned on and off in quite the same way as the charge-eliminating lamp 64. Otherwise, the reduced scale copying is carried out by the same procedure as in the substantially equal scale copying.

While the invention has been described in detail with regard to some specific embodiments shown in the accompanying drawings, it should be understood that the invention is not limited to these specific embodiments, and various changes and modifications are possible without departing from the scope of the invention.

What we claim is:

1. In an electrostatic copying apparatus adapted for copying at variable ratios, an optical device for performing slit exposure scanning of an original document to be copied and projecting its image onto a photosensitive member, said optical device comprising a supporting frame mounted such that it can freely move between at least two positions selected according to the ratio of copying and a lens fixed to the supporting frame; said supporting frame further having an exposure adjusting plate mounted thereon, and said exposure adjusting plate being partly advanced into a light path leading from the document to the photosensitive member when the supporting frame is moved from one of said two positions to the other.

2. The optical device of claim 1 wherein when the supporting frame is at one of said two positions, the image of the document is projected on a substantially equal scale onto the photosensitive member, and when the supporting frame is at the other position, the image of the document is projected on a reduced scale onto the photosensitive member.

3. The optical device of claim 1 or 2 wherein the exposure adjusting plate is advanced into the light path by being moved obliquely to the optical axis.

4. The optical device of claim 1 wherein the exposure adjusting plate is mounted on the supporting frame so that its position can be freely adjusted.

* * * * *